US011817639B2

(12) United States Patent
Yi et al.

(10) Patent No.: US 11,817,639 B2
(45) Date of Patent: Nov. 14, 2023

(54) MINIATURIZED ELECTRICAL CONNECTOR FOR COMPACT ELECTRONIC SYSTEM

(71) Applicant: Amphenol Commercial Products (Chengdu) Co., Ltd., Chengdu (CN)

(72) Inventors: Luyun Yi, Chengdu (CN); Jing Wang, Chengdu (CN)

(73) Assignee: Amphenol Commercial Products (Chengdu) Co., Ltd., Chengdu (CN)

( * ) Notice: Subject to any disclaimer, the term of this patent is extended or adjusted under 35 U.S.C. 154(b) by 25 days.

(21) Appl. No.: 17/402,255

(22) Filed: Aug. 13, 2021

(65) Prior Publication Data

US 2022/0069496 A1 Mar. 3, 2022

(30) Foreign Application Priority Data

Aug. 31, 2020 (CN) ..... 202021855660.5

(51) Int. Cl.
*H01R 12/72* (2011.01)
*H01R 12/73* (2011.01)

(52) U.S. Cl.
CPC ..... *H01R 12/724* (2013.01); *H01R 12/727* (2013.01); *H01R 12/737* (2013.01)

(58) Field of Classification Search
CPC ..... H01R 24/60; H01R 12/62; H01R 12/712; H01R 12/714; H01R 12/716;
(Continued)

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1175101 A 3/1998
CN 1192068 A 9/1998
(Continued)

OTHER PUBLICATIONS

Taiwanese Office Action dated Jun. 16, 2022 for Taiwan Application No. 107138468.
(Continued)

*Primary Examiner* — Marcus E Harcum
(74) *Attorney, Agent, or Firm* — Wolf, Greenfield & Sacks, P.C.

(57) ABSTRACT

The present disclosure provides an electrical connector. The electrical connector comprises an insulative housing and a plurality of terminals disposed in the insulative housing. The insulative housing comprises a top face, a bottom face opposite to the top face, and a plurality of side faces extending between the top face and the bottom face. A corner portion between at least two adjacent side faces of the side faces is formed as a chamfered surface. Such a configuration reduces the dimension of the electrical connector, enables a more compact arrangement of components on the electronic system, and enables the dimension of the electronic system to be reduced, such that the entire assembly, including the electrical connector and the electronic system, can be manufactured at a lower cost and can be more compact and more lightweight.

20 Claims, 10 Drawing Sheets

(58) Field of Classification Search
CPC .. H01R 12/721; H01R 12/724; H01R 12/727; H01R 12/737
See application file for complete search history.

(56) References Cited

U.S. PATENT DOCUMENTS 3,134,950 A 5/1964 Cook
3,322,885 A 5/1967 May et al.
3,530,422 A 9/1970 Goodman
3,573,706 A 4/1971 Haberlen
3,631,381 A 12/1971 Pittman
3,786,372 A 1/1974 Epis et al.
3,825,874 A 7/1974 Peverill
3,863,181 A 1/1975 Glance et al.
3,970,353 A 7/1976 Kaufman
3,977,757 A 8/1976 Yurtin
4,155,613 A 5/1979 Brandeau
4,195,272 A 3/1980 Boutros
4,276,523 A 6/1981 Boutros et al.
4,286,837 A 9/1981 Yasutake et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,487,468 A 12/1984 Fedder et al.
4,490,283 A 12/1984 Kleiner
4,518,651 A 5/1985 Wolfe, Jr.
4,519,664 A 5/1985 Tillotson
4,519,665 A 5/1985 Althouse et al.
4,632,476 A 12/1986 Schell
4,636,752 A 1/1987 Saito
4,682,129 A 7/1987 Bakermans et al.
4,687,267 A 8/1987 Header et al.
4,728,762 A 3/1988 Roth et al.
4,751,479 A 6/1988 Parr
4,761,147 A 8/1988 Gauthier
4,787,548 A 11/1988 Abbagnaro et al.
4,806,107 A 2/1989 Arnold et al.
4,846,724 A 7/1989 Sasaki et al.
4,846,727 A 7/1989 Glover et al.
4,871,316 A 10/1989 Herrell et al.
4,878,155 A 10/1989 Conley
4,948,922 A 8/1990 Varadan et al.
4,970,354 A 11/1990 Iwasa et al.
4,975,084 A 12/1990 Fedder et al.
4,992,060 A 2/1991 Meyer
5,000,700 A 3/1991 Masubuchi et al.
5,066,236 A 11/1991 Broeksteeg
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,171,161 A 12/1992 Kachlic
5,176,538 A 1/1993 Hansell, III et al.
5,266,055 A 11/1993 Naito et al.
5,280,257 A 1/1994 Cravens et al.
5,287,076 A 2/1994 Johnescu et al.
5,334,050 A 8/1994 Andrews
5,340,334 A 8/1994 Nguyen
5,346,410 A 9/1994 Moore, Jr.
5,393,247 A 2/1995 DiOrazio et al.
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,496,183 A 3/1996 Soes et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,810,623 A * 9/1998 Regnier ..... H01R 12/721 439/885
5,831,491 A 11/1998 Buer et al.
5,885,088 A 3/1999 Brennan et al.
5,924,899 A 7/1999 Paagman
5,981,869 A 11/1999 Kroger
5,982,253 A 11/1999 Perrin et al.
5,993,259 A 11/1999 Stokoe et al.
6,019,616 A 2/2000 Yagi et al.
6,152,747 A 11/2000 McNamara
6,168,469 B1 1/2001 Lu
6,174,202 B1 1/2001 Mitra
6,174,203 B1 1/2001 Asao
6,174,944 B1 1/2001 Chiba et al.
6,217,372 B1 4/2001 Reed
6,293,827 B1 9/2001 Stokoe
6,296,491 B1 10/2001 Pickles
6,296,496 B1 10/2001 Trammel
6,299,438 B1 10/2001 Sahagian et al.
6,299,483 B1 10/2001 Cohen et al.
6,315,615 B1 11/2001 Raistrick
6,322,395 B1 11/2001 Nishio et al.
6,328,601 B1 12/2001 Yip et al.
6,347,962 B1 2/2002 Kline
6,350,134 B1 2/2002 Fogg et al.
6,361,363 B1 3/2002 Hwang
6,364,711 B1 4/2002 Berg et al.
6,375,510 B2 4/2002 Asao
6,379,188 B1 4/2002 Cohen et al.
6,394,842 B1 5/2002 Sakurai et al.
6,398,588 B1 6/2002 Bickford
6,409,543 B1 6/2002 Astbury, Jr. et al.
6,447,170 B1 9/2002 Takahashi et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,540,559 B1 4/2003 Kemmick et al.
6,551,140 B2 4/2003 Billman et al.
6,554,647 B1 4/2003 Cohen et al.
6,565,387 B2 5/2003 Cohen
6,565,390 B2 5/2003 Wu
6,579,116 B2 6/2003 Brennan et al.
6,582,244 B2 6/2003 Fogg et al.
6,592,381 B2 7/2003 Cohen et al.
6,595,801 B1 7/2003 Leonard et al.
6,595,802 B1 7/2003 Watanabe et al.
6,602,095 B2 8/2003 Astbury, Jr. et al.
6,607,402 B2 8/2003 Cohen et al.
6,609,922 B2 8/2003 Torii
6,616,864 B1 9/2003 Jiang et al.
6,638,105 B1 * 10/2003 Wu ..... H01R 12/7029 439/567
6,648,682 B1 * 11/2003 Wu ..... H01R 12/7029 439/567
6,652,318 B1 11/2003 Winings et al.
6,652,319 B1 11/2003 Billman
6,655,966 B2 12/2003 Rothermel et al.
6,709,294 B1 3/2004 Cohen et al.
6,713,672 B1 3/2004 Stickney
6,726,492 B1 4/2004 Yu
6,743,057 B2 6/2004 Davis et al.
6,749,463 B1 * 6/2004 Fan ..... H01R 13/658 439/607.23
6,776,659 B1 8/2004 Stokoe et al.
6,786,771 B2 9/2004 Gailus
6,808,420 B2 10/2004 Whiteman, Jr. et al.
6,814,619 B1 11/2004 Stokoe et al.
6,830,489 B2 12/2004 Aoyama
6,872,085 B1 3/2005 Cohen et al.
6,875,031 B1 4/2005 Korsunsky et al.
6,932,649 B1 8/2005 Rothermel et al.
6,979,202 B2 12/2005 Benham et al.

(56) References Cited

U.S. PATENT DOCUMENTS 6,979,226 B2 12/2005 Otsu et al.
6,986,681 B2 1/2006 Tsai
7,008,250 B2 3/2006 Shuey et al.
7,008,267 B2 * 3/2006 Fan ..... H01R 13/658 439/108
7,044,794 B2 5/2006 Consoli et al.
7,057,570 B2 6/2006 Irion, II et al.
7,074,067 B2 7/2006 Yang et al.
7,074,086 B2 7/2006 Cohen et al.
7,086,872 B2 8/2006 Myer et al.
7,094,102 B2 8/2006 Cohen et al.
7,104,842 B1 9/2006 Huang et al.
7,108,556 B2 9/2006 Cohen et al.
7,156,672 B2 1/2007 Fromm et al.
7,163,421 B1 1/2007 Cohen et al.
7,232,344 B1 6/2007 Gillespie et al.
7,285,018 B2 10/2007 Kenny et al.
7,316,585 B2 1/2008 Smith et al.
7,318,740 B1 1/2008 Henry et al.
7,320,614 B2 1/2008 Toda et al.
7,322,845 B2 1/2008 Regnier et al.
7,331,822 B2 2/2008 Chen n
7,335,063 B2 2/2008 Cohen et al.
7,364,464 B2 4/2008 Iino et al.
7,371,117 B2 5/2008 Gailus
7,407,413 B2 8/2008 Minich
7,467,977 B1 12/2008 Yi et al.
7,473,124 B1 1/2009 Briant et al.
7,494,383 B2 2/2009 Cohen et al.
7,540,781 B2 6/2009 Kenny et al.
7,581,990 B2 9/2009 Kirk et al.
7,588,464 B2 9/2009 Kim
7,604,502 B2 10/2009 Pan
7,637,783 B2 12/2009 Sasaoka et al.
7,645,165 B2 1/2010 Wu et al.
7,677,907 B2 3/2010 Guan et al.
7,690,946 B2 4/2010 Knaub et al.
7,699,644 B2 4/2010 Szczesny et al.
7,722,401 B2 5/2010 Kirk et al.
7,727,027 B2 6/2010 Chiang et al.
7,727,028 B1 6/2010 Zhang et al.
7,731,537 B2 6/2010 Amleshi et al.
7,731,541 B1 * 6/2010 Lee ..... H01R 12/716 439/660
7,753,731 B2 7/2010 Cohen et al.
7,771,233 B2 8/2010 Gailus
7,789,676 B2 9/2010 Morgan et al.
7,794,240 B2 9/2010 Cohen et al.
7,794,278 B2 9/2010 Cohen et al.
7,806,729 B2 10/2010 Nguyen et al.
7,824,192 B2 11/2010 Lin et al.
7,871,296 B2 1/2011 Fowler et al.
7,874,873 B2 1/2011 Do et al.
7,883,369 B1 2/2011 Sun et al.
7,887,371 B2 2/2011 Kenny et al.
7,887,379 B2 2/2011 Kirk
7,892,006 B2 2/2011 Guan et al.
7,906,730 B2 3/2011 Atkinson et al.
7,914,304 B2 3/2011 Cartier et al.
7,946,889 B2 5/2011 Mizumura
7,972,171 B2 7/2011 Teh
7,985,097 B2 7/2011 Gulla
7,993,147 B2 8/2011 Cole et al.
8,018,733 B2 9/2011 Jia
8,083,553 B2 12/2011 Manter et al.
8,123,544 B2 2/2012 Kobayashi
8,142,207 B1 * 3/2012 Ljubijankic ..... H01R 13/6473 439/95
8,182,289 B2 5/2012 Stokoe et al.
8,187,031 B2 5/2012 Li et al.
8,215,968 B2 7/2012 Cartier et al.
8,216,001 B2 7/2012 Kirk
8,262,411 B2 9/2012 Kondo
8,272,877 B2 9/2012 Stokoe et al.
8,337,247 B2 12/2012 Zhu
8,348,701 B1 1/2013 Lan et al.
8,371,875 B2 2/2013 Gailus
8,382,524 B2 2/2013 Khilchenko et al.
8,403,689 B2 3/2013 Li et al.
8,440,637 B2 5/2013 Elmen
8,480,432 B2 7/2013 Wu
8,506,319 B2 8/2013 Ritter et al.
8,506,331 B2 8/2013 Wu
8,535,077 B2 9/2013 Shen et al.
8,545,253 B2 10/2013 Amidon et al.
8,550,861 B2 10/2013 Cohen et al.
8,597,051 B2 12/2013 Yang et al.
8,657,627 B2 2/2014 McNamara et al.
8,715,003 B2 5/2014 Buck et al.
8,715,005 B2 5/2014 Pan
8,740,637 B2 6/2014 Wang et al.
8,764,492 B2 7/2014 Chiang
8,771,016 B2 7/2014 Atkinson et al.
8,864,506 B2 10/2014 Little
8,864,521 B2 10/2014 Atkinson et al.
8,905,777 B2 12/2014 Zhu et al.
8,926,377 B2 1/2015 Kirk et al.
8,944,831 B2 2/2015 Stoner et al.
8,968,034 B2 3/2015 Hsu
8,998,642 B2 4/2015 Manter et al.
9,004,942 B2 4/2015 Paniauqa
9,011,177 B2 4/2015 Lloyd et al.
9,022,806 B2 5/2015 Cartier, Jr. et al.
9,028,281 B2 5/2015 Kirk et al.
9,065,230 B2 6/2015 Milbrand, Jr.
9,124,009 B2 9/2015 Atkinson et al.
9,166,317 B2 * 10/2015 Briant ..... H01R 12/737
9,219,335 B2 12/2015 Atkinson et al.
9,225,085 B2 12/2015 Cartier, Jr. et al.
9,246,253 B1 1/2016 Defibaugh et al.
9,257,778 B2 2/2016 Buck et al.
9,257,794 B2 2/2016 Wanha et al.
9,263,835 B2 2/2016 Guo
9,281,590 B1 3/2016 Liu et al.
9,287,668 B2 3/2016 Chen et al.
9,300,074 B2 3/2016 Gailus
9,337,585 B1 5/2016 Yang
9,350,095 B2 5/2016 Arichika et al.
9,431,734 B2 * 8/2016 Guo ..... H01R 13/405
9,450,344 B2 9/2016 Cartier, Jr. et al.
9,484,674 B2 11/2016 Cartier, Jr. et al.
9,509,101 B2 11/2016 Cartier, Jr. et al.
9,520,686 B2 12/2016 Hu et al.
9,520,689 B2 12/2016 Cartier, Jr. et al.
9,537,250 B2 1/2017 Kao et al.
9,640,915 B2 5/2017 Phillips
9,692,183 B2 6/2017 Phillips
9,742,132 B1 8/2017 Hsueh
9,831,605 B2 11/2017 Buck et al.
9,843,135 B2 12/2017 Guetig et al.
9,887,485 B2 * 2/2018 Lambie ..... H01R 13/5219
9,935,385 B2 4/2018 Phillips et al.
9,972,945 B1 5/2018 Huang et al.
9,997,853 B2 6/2018 Little et al.
9,997,871 B2 6/2018 Zhong
10,103,476 B1 10/2018 Qiu et al.
10,122,129 B2 11/2018 Milbrand, Jr. et al.
10,135,165 B2 11/2018 Zuo
10,135,197 B2 11/2018 Little et al.
10,211,577 B2 2/2019 Milbrand, Jr. et al.
10,224,653 B2 3/2019 Niu et al.
10,243,304 B2 3/2019 Kirk et al.
10,270,191 B1 4/2019 Li et al.
10,276,995 B2 4/2019 Little
10,283,910 B1 5/2019 Chen et al.
10,320,102 B2 6/2019 Phillips et al.
10,320,125 B2 6/2019 Ju et al.
10,348,040 B2 7/2019 Cartier, Jr. et al.
10,381,767 B1 8/2019 Milbrand, Jr. et al.
10,431,936 B2 10/2019 Horning et al.
10,439,311 B2 10/2019 Phillips et al.
10,511,128 B2 12/2019 Kirk et al.
10,541,482 B2 1/2020 Sasame et al.
10,573,987 B2 2/2020 Osaki et al.

(56) References Cited

U.S. PATENT DOCUMENTS 10,601,181 B2 3/2020 Lu et al.
10,680,387 B2 6/2020 Cheng et al.
10,714,875 B2 7/2020 Wan et al.
10,741,944 B2 * 8/2020 Long ..... H01R 13/6477
10,777,921 B2 9/2020 Lu et al.
10,797,446 B2 10/2020 Liu et al.
10,826,214 B2 11/2020 Phillips et al.
10,833,437 B2 11/2020 Huang et al.
10,840,622 B2 11/2020 Sasame et al.
10,855,020 B1 * 12/2020 Phillips ..... H01R 12/721
10,916,894 B2 * 2/2021 Kirk ..... H01R 13/6585
10,965,064 B2 3/2021 Hsu et al.
11,146,025 B2 10/2021 Lu et al.
11,189,971 B2 11/2021 Lu
11,264,755 B2 3/2022 Te
11,381,015 B2 7/2022 Lu
2001/0012730 A1 8/2001 Ramey et al.
2001/0042632 A1 11/2001 Manov et al.
2001/0046810 A1 11/2001 Cohen et al.
2002/0042223 A1 4/2002 Belopolsky et al.
2002/0061671 A1 5/2002 Torii
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2002/0123266 A1 9/2002 Ramey et al.
2002/0132518 A1 9/2002 Kobayashi
2002/0146926 A1 10/2002 Fogg et al.
2003/0119360 A1 6/2003 Jiang et al.
2003/0220018 A1 11/2003 Winings et al.
2004/0005815 A1 1/2004 Mizumura et al.
2004/0020674 A1 2/2004 McFadden et al.
2004/0058572 A1 3/2004 Fromm et al.
2004/0115968 A1 6/2004 Cohen
2004/0121652 A1 6/2004 Gailus
2004/0171305 A1 9/2004 McGowan et al.
2004/0196112 A1 10/2004 Welbon et al.
2004/0235352 A1 11/2004 Takemasa
2004/0259419 A1 12/2004 Payne et al.
2005/0042928 A1 * 2/2005 Yi ..... H01R 12/721
439/637
2005/0048818 A1 3/2005 Pan
2005/0048838 A1 3/2005 Korsunsky et al.
2005/0048842 A1 3/2005 Benham et al.
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0019525 A1 1/2006 Lloyd et al.
2006/0068640 A1 3/2006 Gailus
2006/0166560 A1 7/2006 Shuey et al.
2006/0255876 A1 11/2006 Kushta et al.
2006/0276082 A1 12/2006 Hung et al.
2006/0292932 A1 12/2006 Benham et al.
2007/0004282 A1 1/2007 Cohen et al.
2007/0004828 A1 1/2007 Khabbaz
2007/0021000 A1 1/2007 Laurx
2007/0021001 A1 1/2007 Laurx et al.
2007/0021002 A1 1/2007 Laurx et al.
2007/0021003 A1 1/2007 Laurx et al.
2007/0021004 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0155241 A1 7/2007 Lappohn
2007/0173118 A1 * 7/2007 Chen ..... H01R 12/00
439/607.01
2007/0197063 A1 8/2007 Ngo et al.
2007/0218765 A1 9/2007 Cohen et al.
2007/0243764 A1 10/2007 Liu et al.
2007/0293084 A1 12/2007 Ngo
2008/0020640 A1 1/2008 Zhang et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacant et al.
2009/0203259 A1 8/2009 Nguyen et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2009/0305553 A1 12/2009 Thomas et al.
2010/0048058 A1 2/2010 Morgan et al.
2010/0068934 A1 3/2010 Li et al.
2010/0075538 A1 * 3/2010 Ohshida ..... H01R 12/714
439/629
2010/0081302 A1 4/2010 Atkinson et al.
2010/0112846 A1 5/2010 Kotaka
2010/0124851 A1 5/2010 Xiong et al.
2010/0144167 A1 6/2010 Fedder et al.
2010/0203772 A1 8/2010 Mao et al.
2010/0291806 A1 11/2010 Minich et al.
2010/0294530 A1 11/2010 Atkinson et al.
2011/0003509 A1 1/2011 Gailus
2011/0065297 A1 3/2011 Guan et al.
2011/0067237 A1 3/2011 Cohen et al.
2011/0104948 A1 5/2011 Girard, Jr. et al.
2011/0130038 A1 6/2011 Cohen et al.
2011/0136388 A1 * 6/2011 Fu ..... H01R 12/732
439/637
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0275238 A1 11/2011 Iijima et al.
2011/0287663 A1 11/2011 Gailus et al.
2012/0094536 A1 4/2012 Khilchenko et al.
2012/0156929 A1 6/2012 Manter et al.
2012/0178274 A1 7/2012 Manickam
2012/0184145 A1 7/2012 Zeng
2012/0184154 A1 7/2012 Frank et al.
2012/0202363 A1 8/2012 McNamara et al.
2012/0202386 A1 8/2012 McNamara et al.
2012/0202387 A1 * 8/2012 McNamara ..... H01R 13/516
439/629
2012/0214344 A1 8/2012 Cohen et al.
2013/0012038 A1 1/2013 Kirk et al.
2013/0017733 A1 1/2013 Kirk et al.
2013/0065454 A1 3/2013 Milbrand Jr.
2013/0078870 A1 3/2013 Milbrand, Jr.
2013/0078871 A1 3/2013 Milbrand, Jr.
2013/0090001 A1 4/2013 Kagotani
2013/0109232 A1 5/2013 Paniaqua
2013/0143442 A1 6/2013 Cohen et al.
2013/0196553 A1 8/2013 Gailus
2013/0217263 A1 8/2013 Pan
2013/0225006 A1 8/2013 Khilchenko et al.
2013/0237100 A1 9/2013 Affeltranger
2013/0280926 A1 10/2013 Ono
2013/0316590 A1 11/2013 Hon
2014/0004724 A1 1/2014 Cartier, Jr. et al.
2014/0004726 A1 1/2014 Cartier, Jr. et al.
2014/0004746 A1 1/2014 Cartier, Jr. et al.
2014/0024263 A1 1/2014 Dong et al.
2014/0057498 A1 2/2014 Cohen
2014/0113487 A1 4/2014 Chen et al.
2014/0273557 A1 9/2014 Cartier, Jr. et al.
2014/0273627 A1 9/2014 Cartier, Jr. et al.
2014/0370729 A1 12/2014 Wang
2014/0377992 A1 12/2014 Chang et al.
2015/0056856 A1 2/2015 Atkinson et al.
2015/0072546 A1 3/2015 Li

(56) References Cited

U.S. PATENT DOCUMENTS

| | | | | |
|---|---|---|---|---|
| 2015/0099408 | A1 | 4/2015 | Myer et al. | |
| 2015/0111401 | A1 | 4/2015 | Guo | |
| 2015/0111427 | A1 | 4/2015 | Foxconn | |
| 2015/0126068 | A1 | 5/2015 | Fang | |
| 2015/0140866 | A1 | 5/2015 | Tsai et al. | |
| 2015/0214673 | A1 | 7/2015 | Gao et al. | |
| 2015/0236451 | A1 | 8/2015 | Cartier, Jr. et al. | |
| 2015/0236452 | A1 | 8/2015 | Cartier, Jr. et al. | |
| 2015/0255904 | A1 | 9/2015 | Ito | |
| 2015/0255926 | A1 | 9/2015 | Paniagua | |
| 2015/0340798 | A1 | 11/2015 | Kao et al. | |
| 2016/0118736 | A1* | 4/2016 | Hoyack | H01R 24/542 439/246 |
| 2016/0149343 | A1 | 5/2016 | Atkinson et al. | |
| 2016/0268744 | A1 | 9/2016 | Little et al. | |
| 2017/0077654 | A1 | 3/2017 | Yao et al. | |
| 2017/0302031 | A1* | 10/2017 | Cheng | H01R 24/64 |
| 2017/0352970 | A1 | 12/2017 | Liang et al. | |
| 2018/0062323 | A1 | 3/2018 | Kirk et al. | |
| 2018/0076555 | A1 | 3/2018 | Scholeno et al. | |
| 2018/0145438 | A1 | 5/2018 | Cohen | |
| 2018/0198220 | A1* | 7/2018 | Sasame | H01R 12/716 |
| 2018/0205177 | A1 | 7/2018 | Zhou et al. | |
| 2018/0212376 | A1 | 7/2018 | Wang et al. | |
| 2018/0212385 | A1 | 7/2018 | Little | |
| 2018/0219331 | A1 | 8/2018 | Cartier, Jr. et al. | |
| 2018/0241156 | A1 | 8/2018 | Huang et al. | |
| 2018/0269607 | A1 | 9/2018 | Wu et al. | |
| 2018/0331444 | A1 | 11/2018 | Ono | |
| 2019/0006778 | A1 | 1/2019 | Fan et al. | |
| 2019/0044284 | A1 | 2/2019 | Dunham | |
| 2019/0052019 | A1 | 2/2019 | Huang et al. | |
| 2019/0067854 | A1 | 2/2019 | Ju et al. | |
| 2019/0165518 | A1* | 5/2019 | Hsu | H01R 13/6471 |
| 2019/0173209 | A1* | 6/2019 | Lu | H01R 13/6599 |
| 2019/0173232 | A1* | 6/2019 | Lu | H01R 13/6594 |
| 2019/0199023 | A1 | 6/2019 | Soh | |
| 2019/0214755 | A1 | 7/2019 | Manickam | |
| 2019/0334292 | A1 | 10/2019 | Cartier, Jr. et al. | |
| 2020/0021052 | A1 | 1/2020 | Milbrand, Jr. et al. | |
| 2020/0076131 | A1* | 3/2020 | Hu | H01R 13/6597 |
| 2020/0076135 | A1* | 3/2020 | Tang | H01R 12/724 |
| 2020/0153134 | A1 | 5/2020 | Sasame et al. | |
| 2020/0161811 | A1 | 5/2020 | Lu | |
| 2020/0203865 | A1 | 6/2020 | Wu et al. | |
| 2020/0203867 | A1 | 6/2020 | Lu | |
| 2020/0203886 | A1 | 6/2020 | Wu et al. | |
| 2020/0235529 | A1 | 7/2020 | Kirk et al. | |
| 2020/0259294 | A1 | 8/2020 | Lu | |
| 2020/0266584 | A1 | 8/2020 | Lu | |
| 2020/0335914 | A1 | 10/2020 | Hsu et al. | |
| 2020/0358226 | A1 | 11/2020 | Lu et al. | |
| 2020/0395698 | A1 | 12/2020 | Hou et al. | |
| 2020/0403350 | A1 | 12/2020 | Hsu | |
| 2021/0036452 | A1 | 2/2021 | Phillips et al. | |
| 2021/0050683 | A1 | 2/2021 | Sasame et al. | |
| 2021/0135389 | A1 | 5/2021 | Jiang | |
| 2021/0135403 | A1 | 5/2021 | Yang et al. | |
| 2021/0135404 | A1 | 5/2021 | Jiang | |
| 2021/0203104 | A1 | 7/2021 | Chen | |
| 2021/0218195 | A1 | 7/2021 | Hsu et al. | |
| 2021/0288423 | A1 | 9/2021 | Guo et al. | |
| 2021/0351529 | A1* | 11/2021 | Yang | H01R 13/6597 |
| 2021/0376508 | A1 | 12/2021 | Hu | |
| 2021/0399449 | A1 | 12/2021 | Guo et al. | |
| 2022/0037828 | A1 | 2/2022 | Hu et al. | |
| 2022/0059954 | A1 | 2/2022 | Yue | |
| 2022/0181811 | A1 | 6/2022 | Liu et al. | |

FOREIGN PATENT DOCUMENTS

| | | | |
|---|---|---|---|
| CN | 1275825 | A | 12/2000 |
| CN | 2519434 | Y | 10/2002 |
| CN | 1179448 | C | 12/2004 |
| CN | 1650479 | A | 8/2005 |
| CN | 1799290 | A | 7/2006 |
| CN | 2896615 | Y | 5/2007 |
| CN | 1996678 | A | 7/2007 |
| CN | 2930006 | Y | 8/2007 |
| CN | 101019277 | A | 8/2007 |
| CN | 101176389 | A | 5/2008 |
| CN | 101208837 | A | 6/2008 |
| CN | 101312275 | A | 11/2008 |
| CN | 201323275 | Y | 10/2009 |
| CN | 101600293 | A | 12/2009 |
| CN | 201374434 | Y | 12/2009 |
| CN | 101752700 | A | 6/2010 |
| CN | 101790818 | A | 7/2010 |
| CN | 101120490 | B | 11/2010 |
| CN | 101926055 | A | 12/2010 |
| CN | 201846527 | U | 5/2011 |
| CN | 102106041 | A | 6/2011 |
| CN | 201868621 | U | 6/2011 |
| CN | 102195173 | A | 9/2011 |
| CN | 102224640 | A | 10/2011 |
| CN | 102232259 | A | 11/2011 |
| CN | 102239605 | A | 11/2011 |
| CN | 102292881 | A | 12/2011 |
| CN | 101600293 | B | 5/2012 |
| CN | 102456990 | A | 5/2012 |
| CN | 102487166 | A | 6/2012 |
| CN | 102593661 | A | 7/2012 |
| CN | 102598430 | A | 7/2012 |
| CN | 202395248 | U | 8/2012 |
| CN | 102694318 | A | 9/2012 |
| CN | 102738621 | A | 10/2012 |
| CN | 202633554 | U | 12/2012 |
| CN | 102859805 | A | 1/2013 |
| CN | 202695788 | U | 1/2013 |
| CN | 202695861 | U | 1/2013 |
| CN | 203445304 | U | 2/2014 |
| CN | 103840285 | A | 6/2014 |
| CN | 203660106 | U | 6/2014 |
| CN | 203690614 | U | 7/2014 |
| CN | 204030057 | U | 12/2014 |
| CN | 204167554 | U | 2/2015 |
| CN | 104409906 | A | 3/2015 |
| CN | 104577577 | A | 4/2015 |
| CN | 104659573 | A | 5/2015 |
| CN | 204349140 | U | 5/2015 |
| CN | 204577746 | U | 8/2015 |
| CN | 204696287 | U | 10/2015 |
| CN | 105633660 | A | 6/2016 |
| CN | 105703103 | A | 6/2016 |
| CN | 106099546 | A | 11/2016 |
| CN | 107069281 | A | 8/2017 |
| CN | 304240766 | S | 8/2017 |
| CN | 304245430 | S | 8/2017 |
| CN | 206712072 | U | 12/2017 |
| CN | 206712089 | U | 12/2017 |
| CN | 107706632 | A | 2/2018 |
| CN | 207677189 | U | 7/2018 |
| CN | 108539464 | A | 9/2018 |
| CN | 208078300 | U | 11/2018 |
| CN | 208209042 | U | 12/2018 |
| CN | 208797273 | U | 4/2019 |
| CN | 210326355 | U | 4/2020 |
| CN | 112072400 | A | 12/2020 |
| CN | 107706675 | B | 4/2021 |
| CN | 212874843 | U | 4/2021 |
| CN | 113517619 | A | 10/2021 |
| CN | 214505858 | U | 10/2021 |
| DE | 60216728 | T2 | 11/2007 |
| EP | 0 560 551 | A1 | 9/1993 |
| EP | 0 820 124 | A2 | 1/1998 |
| EP | 1 018 784 | A1 | 7/2000 |
| EP | 1 779 472 | A1 | 5/2007 |
| EP | 2 169 770 | A2 | 3/2010 |
| EP | 2 405 537 | A1 | 1/2012 |
| GB | 227943 | A | 1/1925 |
| GB | 1049435 | A | 11/1966 |
| GB | 1272347 | A | 4/1972 |
| JP | H3-156761 | A2 | 7/1991 |

(56) References Cited

FOREIGN PATENT DOCUMENTS

| | | | |
|---|---|---|---|
| JP | H07-302649 | A | 11/1995 |
| JP | 2001-510627 | A | 7/2001 |
| JP | 2002-151190 | A2 | 5/2002 |
| JP | 2006-344524 | A | 12/2006 |
| JP | 2010-129173 | A | 6/2010 |
| MX | 9907324 | A1 | 8/2000 |
| TW | 200835073 | A | 8/2008 |
| TW | M357771 | U | 5/2009 |
| TW | M474278 | U | 3/2014 |
| TW | M475740 | U | 4/2014 |
| TW | M502979 | U | 6/2015 |
| TW | I535129 | B | 5/2016 |
| TW | M534922 | U | 1/2017 |
| TW | I596840 | B | 8/2017 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| TW | M605564 | U | 12/2020 |
| WO | WO 88/05218 | A1 | 7/1988 |
| WO | WO 98/35409 | A1 | 8/1998 |
| WO | WO 02/073819 | A2 | 9/2002 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124052 | A2 | 10/2008 |
| WO | WO 2008/124054 | A2 | 10/2008 |
| WO | WO 2008/124057 | A2 | 10/2008 |
| WO | WO 2008/124101 | A2 | 10/2008 |
| WO | WO 2010/030622 | A1 | 3/2010 |
| WO | WO 2010/039188 | A1 | 4/2010 |
| WO | WO 2011/100740 | A2 | 8/2011 |
| WO | WO 2017/007429 | A1 | 1/2017 |

OTHER PUBLICATIONS

[No Author Listed], DDR5 Memory Module Sockets (SMT). Storage & Server IO. Amphenol ICC. 2022. 2 pages. URL:https://cdn.amphenol-cs.com/media/wysiwyg/files/documentation/datasheet/ssio/ssio_ddr5_smt.pdf [last accessed Mar. 22, 2022].

[No Author Listed], DDR5 SDRAM—Wikipedia. Aug. 8, 2021. 6 pages. URL:https://en.wikipedia.org/wiki/DDR5_SDRAM [last accessed on Aug. 16, 2021].

Armasu, What We Know About DDR5 So Far. Jun. 7, 2019. 20 pages. URL:https://www.tomshardware.com/news/what-we-know-ddr5-ram,39079.html [last accessed Jul. 21, 2022].

Hsu, Compact Electrical Connector, U.S. Appl. No. 17/867,067, filed Jul. 18, 2022.

Lu et al., Robust, Miniaturized Card Edge Connector, U.S. Appl. No. 17/856,507, filed Jul. 1, 2022.

Chinese communication for Chinese Application No. 201580014851.4, dated Jun. 1, 2020.

Chinese Office Action for Chinese Application No. 201580014851.4 dated Sep. 4, 2019.

Chinese Office Action for Application No. 201680051491.X dated Apr. 30, 2019.

Chinese Office Action for Chinese Application No. 201780064531.9 dated Jan. 2, 2020.

Chinese Office Action for Chinese Application No. 201780097919.9, dated Dec. 3, 2021.

Chinese Office Action for Chinese Application No. 201780097919.9, dated Mar. 10, 2021.

Chinese Office Action dated Jan. 18, 2021 in connection with Chinese Application No. 202010031395.7.

Extended European Search Report for European Application No. EP 11166820.8 dated Jan. 24, 2012.

Extended European Search Report dated May 19, 2021 in connection with European Application No. 17930428.2.

International Search Report and Written Opinion for International Application No. PCT/CN2017/108344 dated Aug. 1, 2018.

International Preliminary Report on Patentability Chapter II for International Application No. PCT/CN2017/108344 dated Mar. 6, 2020.

International Preliminary Report on Patentability for International Application No. PCT/SG2016/050317 dated Jan. 18, 2018.

International Search Report and Written Opinion for International Application No. PCT/SG2016/050317 dated Oct. 18, 2016.

International Search Report with Written Opinion for International Application No. PCT/US2006/025562 dated Oct. 31, 2007.

International Search Report and Written Opinion for International Application No. PCT/US2005/034605 dated Jan. 26, 2006.

International Preliminary Report on Patentability for International Application No. PCT/US2010/056482 dated May 24, 2012.

International Search Report and Written Opinion for International Application No. PCT/US2010/056482 dated Mar. 14, 2011.

International Preliminary Report on Patentability for International Application No. PCT/US2011/026139 dated Sep. 7, 2012.

International Search Report and Written Opinion for International Application No. PCT/US2011/026139 dated Nov. 22, 2011.

International Search Report and Written Opinion for International Application No. PCT/US2011/034747 dated Jul. 28, 2011.

International Preliminary Report on Patentability for International Application No. PCT/US2012/023689 dated Aug. 15, 2013.

International Search Report and Written Opinion for International Application No. PCT/US2012/023689 dated Sep. 12, 2012.

International Search Report and Written Opinion for International Application No. PCT/US2012/060610 dated Mar. 29, 2013.

International Search Report and Written Opinion for International Application No. PCT/US2015/012463 dated May 13, 2015.

International Search Report and Written Opinion for International Application No. PCT/US2017/047905 dated Dec. 4, 2017.

International Search Report and Written Opinion dated Nov. 29, 2021 for International Application No. PCT/CN2021/114671.

International Search Report and Written Opinion dated Jul. 18, 2019 for International Application No. PCT/CN2018/118798.

[No Author Listed], Mini Cool Edge IO—The Ideal Solution to Transmit Next Generation High-Speed Signal to Designated Area in Your System. Jul. 25, 2018. 2 pages. URL:https://www.amphenol-icc.com/connect/mini-cool-edge-io-the-ideal-solution-to-transmit-next-generation-high-speedsignal.html [retrieved on Apr. 11, 2022].

[No Author Listed], Mini Cool Edge IO Connector. Commercial IO. Amphenol ICC. 5 pages. URL:https://cdn.amphenol-icc.com/media/wysiwyg/files/documentation/datasheet/inputoutput/io_mini_cool_edge_io.pdf [retrieved on Apr. 11, 2022].

[No Author Listed], MCIO 124pos 85ohm. Amphenol Assembletech. 1 page. URL:http://www.amphenol-ast.com/v3/en/overview.aspx?classId=234 [retrieved on Apr. 11, 2022].

[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.

[No Author Listed], High Speed Backplane Connectors. Tyco Electronics. Product Catalog No. 1773095. Revised Dec. 2008. 1-40 pages.

[No Author Listed], Military Fibre Channel High Speed Cable Assembly, www.gore.com. 2008. [last accessed Aug. 2, 2012 via Internet Archive: Wayback Machine http://web.archive.org] Link archived: http://www.gore.com/en.sub.--xx/products/cables/copper/networking/militar-y/military.sub.--fibre . . . Last archive date Apr. 6, 2008.

[No Author Listed], SFF-TA-1016 Specification for Internal Unshielded High Speed Connector System. Rev 0.0.1. SNIA SFF TWG Technology Affiliate. Nov. 15, 2019. 40 pages.

(56) References Cited

OTHER PUBLICATIONS

Beaman, High Performance Mainframe Computer Cables. 1997 Electronic Components and Technology Conference. 1997;911-7.
Reich et al., Microwave Theory and Techniques. Boston Technical Publishers, Inc. 1965;182-91.
Shi et al. Improving Signal Integrity in Circuit Boards by Incorporating Absorbing Materials. 2001 Proceedings. 51st Electronic Components and Technology Conference, Orlando FL. 2001:1451-56.

* cited by examiner

MINIATURIZED ELECTRICAL CONNECTOR FOR COMPACT ELECTRONIC SYSTEM

RELATED APPLICATIONS

This application claims priority to and the benefit of Chinese Patent Application Serial No. 202021855660.5, filed on Aug. 31, 2020. The entire contents of this application are incorporated herein by reference in their entirety.

FIELD

This application relates to electrical connectors, and in particular to an electrical connector for providing an electrical connection between electronic systems, such as printed circuit boards (PCBs).

BACKGROUND

Electrical connectors may be used to electrically connect different electronic systems together. One typical electrical connector is a card edge connector that may be mounted onto a first electronic system, such as a motherboard, such that tail portions of terminals of the card edge connector may be electrically connected to conductive portions of the first electronic system by, for example, soldering. The card edge connector may also act as a female connector for interfacing directly with conductive portions on or near an edge of a PCB of a second electronic system, such as a daughter card, such that the conductive portions of the second electronic system are in contact with the contact portions of the corresponding terminals of the card edge connector. In this case, the PCB itself acts as a male connector for interfacing with the card edge connector, without the need for a separate male connector. In this way, the conductive portions of the second electronic system may be electrically connected to the corresponding conductive portions of the first electronic system via the terminals of the card edge connector, thereby establishing an electrical connection between the first electronic system and the second electronic system. This makes it possible to manufacture individual PCBs for a specific purpose and then electrically connect the individual PCBs together using the card edge connector(s) to form a desired system, rather than manufacturing the entire system as a single component.

BRIEF SUMMARY

Aspects of the present disclosure relate to miniaturized electrical connectors for compact electronic systems.

Some embodiments relate to an electrical connector. The electrical connector may include an insulative housing, and a plurality of terminals disposed in the insulative housing. The insulative housing may include a top face comprising a socket, a bottom face opposite to the top face, and a plurality of side faces extending between the top face and the bottom face, the plurality of side faces comprising first and second side faces extending perpendicularly to each other. Each of the plurality of terminals may include a contact portion and a tail portion, the contact portion being accessible through the socket of the insulative housing, and the tail portion protruding from the bottom face of the insulative housing. The insulative housing comprises a chamfered surface connecting one of the first side faces and one of the second side faces.

In some embodiments, the insulative housing may include a platform projecting outwardly at one end of the insulative housing that is proximate to the bottom face.

In some embodiments, the platform may include a corner portion comprising the chamfered surface.

In some embodiments, the chamfered surface may be a first chamfered surface. The platform may include a second chamfered surface such that the platform has a trapezoidal shape.

In some embodiments, the plurality of terminals may be arranged in two terminal rows mutually opposed and spaced apart in the insulative housing, with the terminals in each terminal row aligned therein.

In some embodiments, the electrical connector may include at least one retention mechanism for retaining the plurality of terminals in place relative to each other.

In some embodiments, the at least one retention mechanism may be overmolded around the plurality of terminals.

In some embodiments, the insulative housing may include the at least one retention mechanism.

In some embodiments, the at least one retention mechanism may be formed separately from the insulative housing and removably mounted into the insulative housing.

In some embodiments, the retention mechanism may include two halves having interlocking mechanisms. Each half may retain a terminal row formed by some of the plurality of terminals.

In some embodiments, the electrical connector may include a positioning mechanism for ensuring a proper positioning of the electrical connector on the electronic system when the electrical connector is mounted to an electronic system.

In some embodiments, the electrical connector may include a fixing mechanism for fixing the electrical connector to an electronic system.

In some embodiments, the electrical connector may be a vertical connector or a right angle connector.

In some embodiments, the electronic system may be a printed circuit board.

In some embodiments, the one of the first side faces may extend in a first plane. The one of the second side faces may extend in a second plane. The first plane and the second plane may cross each other along a line. The chamfered surface may be spaced from the line by a distance no less than 0.36 mm.

In some embodiments, the platform may include slots for receiving tabs.

Some embodiments relate to an electronic system. The electronic system may include a printed circuit board; and an electrical connector. The electrical connector may include an insulative housing and a plurality of terminals disposed in the insulative housing. The insulative housing may include a socket, a bottom face mounted against the printed circuit board, and a plurality of side faces extending perpendicular to the bottom face, the plurality of side faces comprising first and second side faces extending perpendicularly to each other. Each of the plurality of terminals may include a contact portion and a tail portion, the contact portion being accessible through the socket of the insulative housing, and the tail portion protruding from the bottom face of the insulative housing. The printed circuit board may include a first edge and a second edge and curved corner joining the first edge and the second edge. The electrical connector may be mounted to the printed circuit board with the first side face adjacent and parallel to the first edge and the second side face adjacent and parallel to the second edge. The insulative housing may include an angled surface connecting the first side face and the second side face. The angled surface may be mounted adjacent the curved corner.

In some embodiments, the insulative housing may include a socket portion including the socket and at least one platform extending from the socket portion in a direction parallel to the bottom face. The angled surface may include a surface of a platform of the at least one platform.

In some embodiments, the platform may be a first platform. The at least one platform may include a second platform, extending from the socket portion in a direction opposite the first platform. The angled surface may be a first angled surface. The second platform may include a second angled surface.

In some embodiments, the electronic system may include a plurality of fixing tabs extending through the first platform and the second platform and engaging the electrical connector to the printed circuit board Some embodiments relate to an electrical connector. The electrical may include an insulative housing comprising a top face, a bottom face opposite to the top face and a plurality of side faces extending between the top face and the bottom face; and a plurality of terminals disposed in the insulative housing, each of the plurality of terminals comprising a contact portion and a tail portion, the contact portion being accessible through a socket in the insulative housing, and the tail portion protruding from the bottom face and configured to be mounted to an electronic system. A corner portion between at least two adjacent side faces of the side faces is formed as a chamfered surface.

In some embodiments, a portion of at least one end of the insulative housing that is proximate to the bottom face may project outwardly to form a platform.

In some embodiments, the chamfered surface may be formed at a corner portion of the platform.

In some embodiments, each of two corner portions of the platform may be formed as the chamfered surface such that the platform has a trapezoidal shape.

In some embodiments, the plurality of terminals may be arranged in two terminal rows mutually opposed and spaced apart in the insulative housing, with the terminals in each terminal row aligned therein.

In some embodiments, the electrical connector may include at least one retention mechanism for retaining the plurality of terminals in place relative to each other.

In some embodiments, the at least one retention mechanism may be overmolded around the plurality of terminals.

In some embodiments, the at least one retention mechanism may be provided by the insulative housing.

In some embodiments, the at least one retention mechanism may be formed separately from the insulative housing and removably mounted into the insulative housing.

In some embodiments, the retention mechanism may include two halves having interlocking mechanisms, each half retaining a terminal row formed by some of the plurality of terminals.

In some embodiments, the electrical connector may include a positioning mechanism provided on the insulative housing for ensuring a proper positioning of the electrical connector on the electronic system when the electrical connector is mounted to the electronic system.

In some embodiments, the electrical connector may include a fixing mechanism provided on the insulative housing for fixing the electrical connector to the electronic system.

In some embodiments, the electrical connector may be a vertical connector or a right angle connector.

In some embodiments, the electronic system may be a printed circuit board.

In some embodiments, the corner portion being formed as the chamfered surface may allow the corner portion to be indented inward by at least 0.36 mm, as compared to the case where the corner portion is not formed as the chamfered surface.

These techniques may be used alone or in any suitable combination. The foregoing summary is provided by way of illustration and is not intended to be limiting.

BRIEF DESCRIPTION OF DRAWINGS

The above and other aspects of the present disclosure will be more thoroughly understood and appreciated below when read in conjunction with the appended drawings. It should be noted that the appended drawings are only schematic and are not drawn to scale. In the appended drawings.

LIST OF REFERENCE NUMERALS

Figure 1:
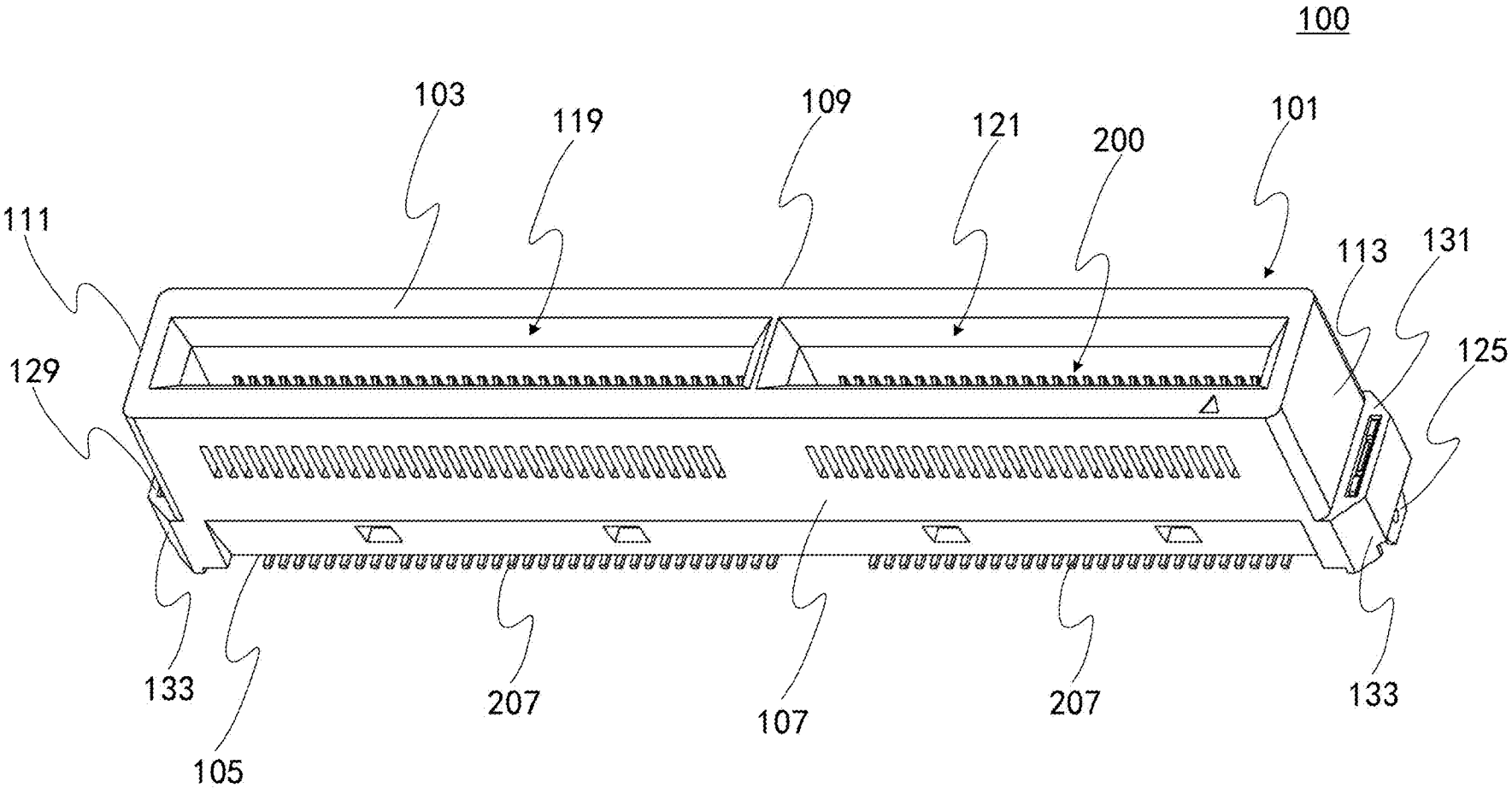
FIG. 1 is a top, side perspective view of a vertical connector, according to some embodiments.
Figure 2:
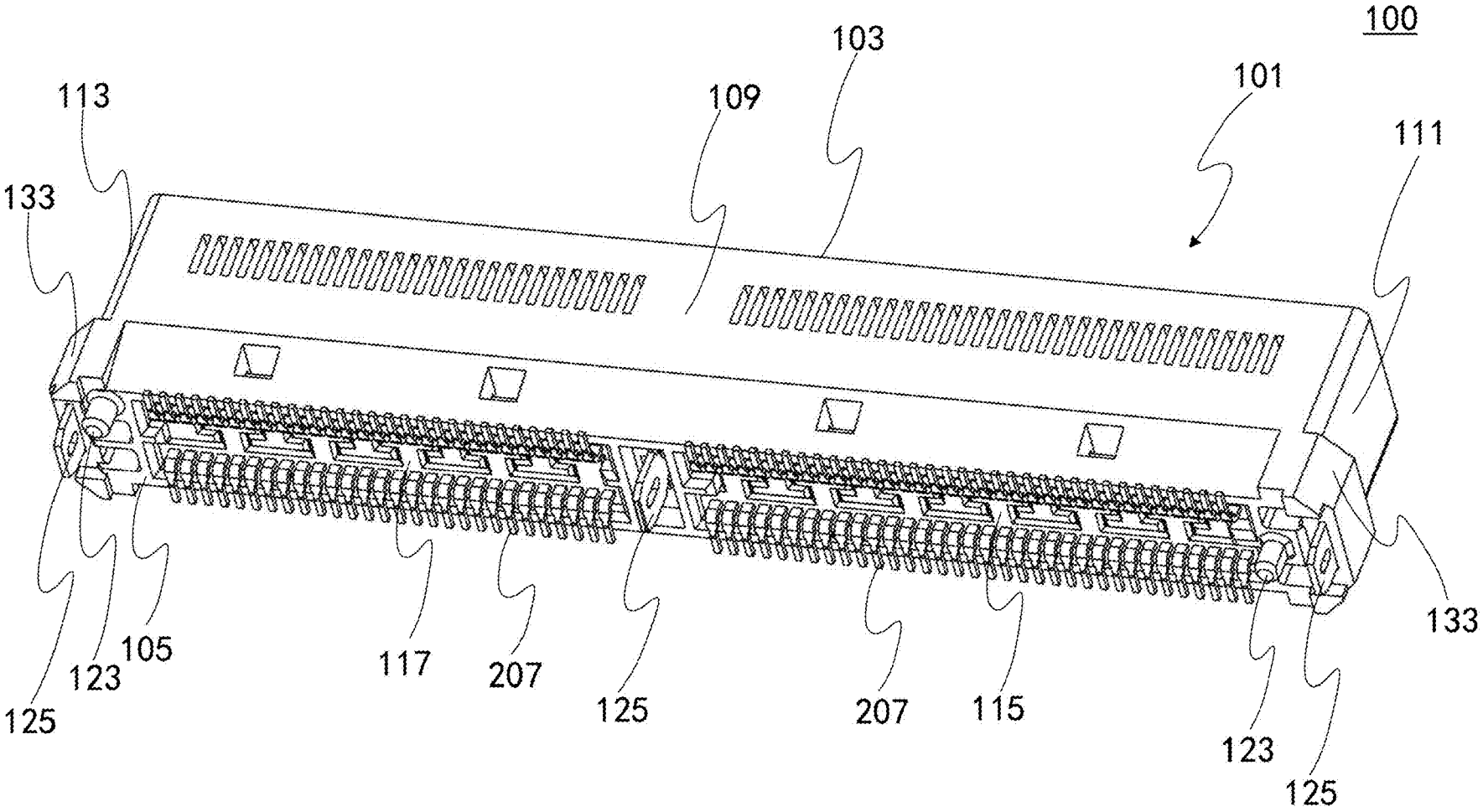
FIG. 2 is a bottom, side perspective view of the vertical connector shown in FIG. 1.
Figure 3:
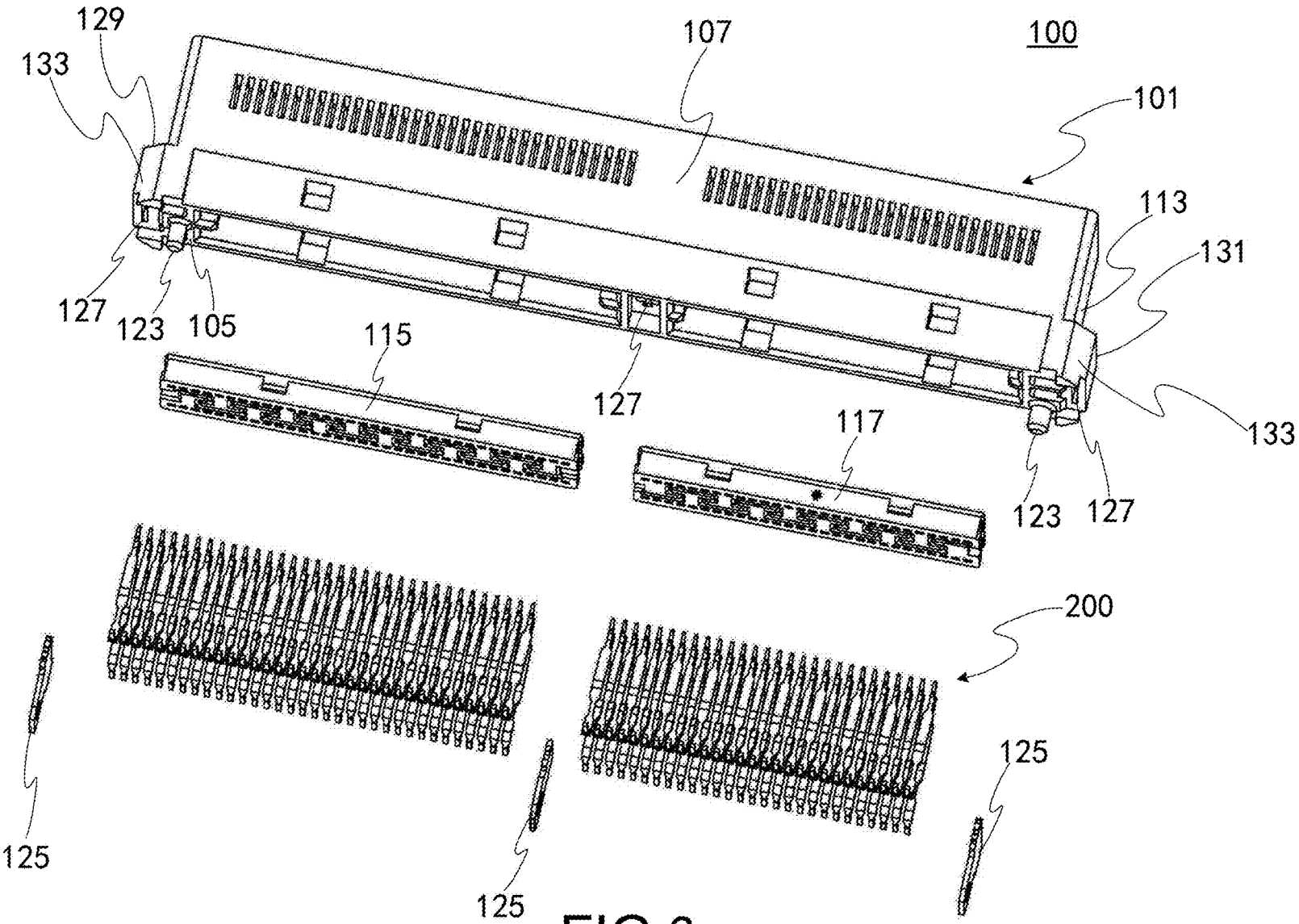
FIG. 3 is an exploded view of the vertical connector shown in FIG. 1.

100 vertical connector
101 housing
103 top face
105 bottom face
107 front side face
109 rear side face
111 left side face
113 right side face
115 first retention mechanism
117 second retention mechanism
119 first socket

121 second socket
123 positioning protrusion
125 fixing tab
127 receiving slot
129 first platform
131 second platform
133 chamfered surface
200 terminals
201 tip portion
203 contact portion
205 body portion
207 tail portion
210 ground terminal
220 first signal terminal
230 second signal terminal
240 additional ground terminal
300 terminal row
400 printed circuit board
401 edge.

DETAILED DESCRIPTION

Disclosed herein is a miniaturized electrical connector. The electrical connector may include an insulative housing and a plurality of terminals disposed in the insulative housing. The insulative housing may include a top face, a bottom face opposite to the top face, and a plurality of side faces extending between the top face and the bottom face. Each of the plurality of terminals may include a contact portion and a tail portion. The contact portion may be accessible through a socket in the insulative housing, and the tail portion may protrude from the bottom face and may be capable of being mounted to an electronic system. A corner portion between at least two adjacent side faces of the side faces may be formed as a chamfered surface.

Such configuration may reduce the dimension of the electrical connector. For example, when the electrical connector is mounted to an electronic system such as a PCB, the electrical connector may occupy less space and be disposed closer to other components on the electronic system, enabling a more compact arrangement of the components on the electronic system. Alternatively or additionally, the electrical connector may be disposed closer to an edge of the electronic system, such that the space utilization on the electronic system can be optimized. These also enable the dimension of the electronic system to be reduced, such that the entire assembly, including the electrical connector and the electronic system, can be manufactured at a lower cost and can be more compact and more lightweight.

The electrical connectors of the present disclosure may be various types of card edge connectors, including but not limited to, vertical connectors and right angle connectors. Preferred embodiments of the present disclosure are described in detail below in conjunction with some examples. It should be appreciated by the skilled person in the art that these embodiments are not meant to form any limitation on the present disclosure.

The vertical connector 100 according to a preferred embodiment of the present disclosure will be described below in conjunction with FIGS. 1 to 8C. As shown in FIGS. 1 to 6, the vertical connector 100 may include a housing 101. The housing 101 may be partially or entirely formed of an insulative material. Examples of insulative materials that are suitable for forming the housing 101 include, but are not limited to, plastic, nylon, liquid crystal polymer (LCP), polyphenyline sulfide (PPS), high temperature nylon or polyphenylenoxide (PPO) or polypropylene (PP). The housing 101 may have a substantially bar shaped body and may include a top face 103, a bottom face 105 opposite to the top face 103 and a plurality of side faces extending between the top face 103 and the bottom face 105. In some examples, the housing 101 may include four side faces, i.e., wider front and rear side faces 107 and 109 and narrower left and right side faces 111 and 113.

The vertical connector 100 may further include a plurality of terminals 200 housed in the housing 101. Each of the plurality of terminals 200 may be formed of a conductive material. Conductive materials that are suitable for forming the terminals 200 may be a metal, such as copper, or a metal alloy. A set of three terminals 200 may be configured for transmitting differential signals between a first electronic device (e.g., a motherboard) and a second electronic device (e.g., a daughter board).

Figure 7A:
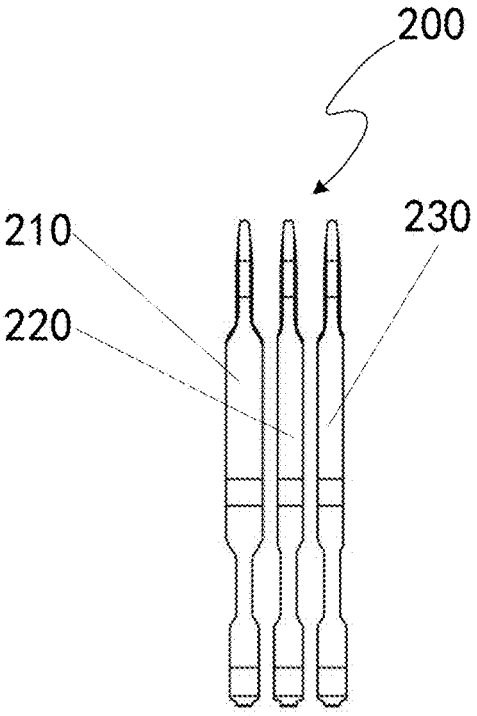
FIG. 7A is a front plan view of a set of three terminals that may be used in the vertical connector shown in FIG. 1.
Figure 7B:
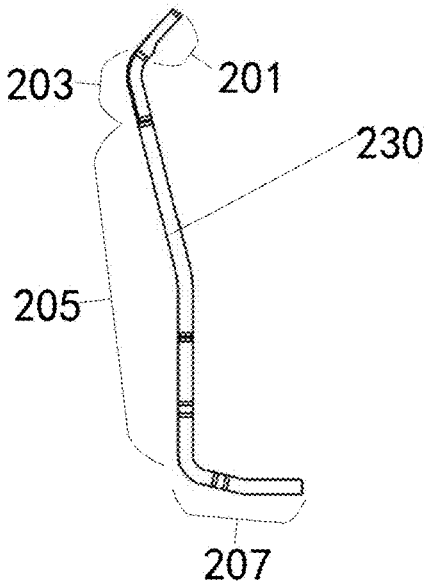
FIG. 7B is a right side plan view of the set of three terminals shown in FIG. 7A.
Figure 7C:
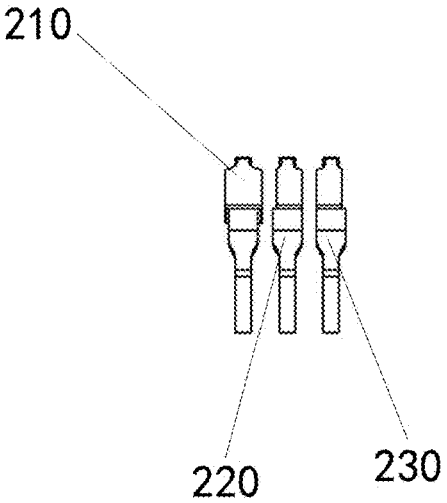
FIG. 7C is a bottom plan view of the set of three terminals shown in FIG. 7A.
Figure 7D:
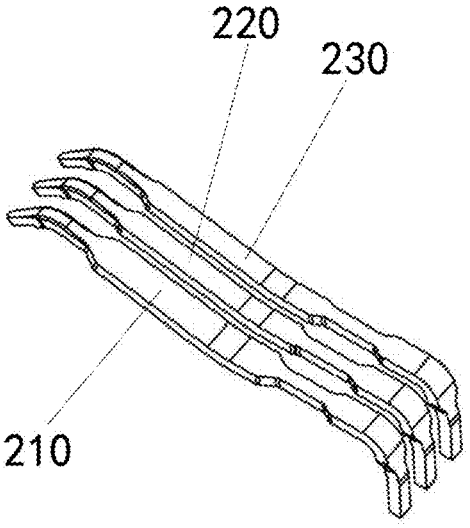
FIG. 7D is a perspective view of the set of three terminals shown in FIG. 7A.

Turning to FIGS. 7A to 7D, FIGS. 7A to 7D illustrate in detail a set of three terminals 200 that may be used in the vertical connector 100, i.e., a ground terminal 210, a first signal terminal 220 and a second signal terminal 230. FIG. 7A is a front view of the set of three terminals 200. FIG. 7B is a right side view of the set of three terminals 200 shown in FIG. 7A, but only the second signal terminal 230 is visible because all of the three terminals have the same profiles when viewed from the right side thereof. FIG. 7C is a bottom view of the set of three terminals 200 shown in FIG. 7A. FIG. 7D is a perspective view of the set of three terminals 200 shown in FIG. 7A.

The first signal terminal 220 and the second signal terminal 230 may constitute a differential signaling pair. Each of the ground terminal 210, the first signal terminal 220 and the second signal terminal 230 includes a tip portion 201, a contact portion 203, a body portion 205 and a tail portion 207. The tail portion 207 may be configured for being connected to a first PCB (e.g., a motherboard). The contact portion 203 may be configured to establish an electrical contact with a conductive portion of another electronic system (e.g., another PCB).

In some examples, the distance D1 between the distal ends of the tip portion 201 of the first signal terminal 220 and the tip portion 201 of the second signal terminal 230 is equal to the distance D2 between the distal ends of the tip portion 201 of the first signal terminal 220 and the tip portion 201 of the ground terminal 210. In some examples, the distance D3 between the contact portion 203 of the first signal terminal 220 and the contact portion 203 of the second signal terminal 230 is equal to the distance D4 between the contact portion 203 of the first signal terminal 220 and the contact portion 203 of the ground terminal 210. In some examples, the distances D3 and D4 are less than the distances D1 and D2, respectively. As a non-limiting example, D1 and D2 may be equal to 0.6 mm, and D3 and D4 may be equal to 0.38 mm. The vertical connector 100 has a terminal pitch equal to D1. Thus, in the example where D1 is equal to 0.6 mm, the vertical connector 100 may be referred to as a 0.6 mm card edge connector.

Figure 8A:
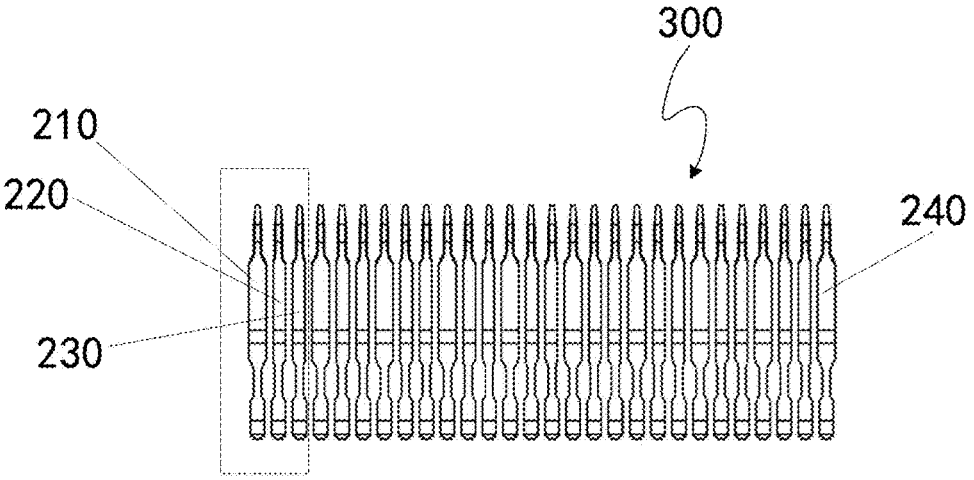
FIG. 8A is a front plan view of a terminal row comprising nine sets of the three terminals shown in FIG. 7A and an additional ground terminal.
Figure 8B:
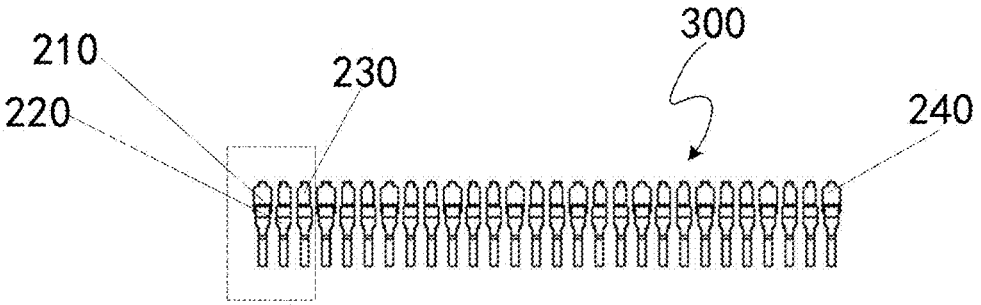
FIG. 8B is a bottom plan view of the terminal row shown in FIG. 8A.
Figure 8C:
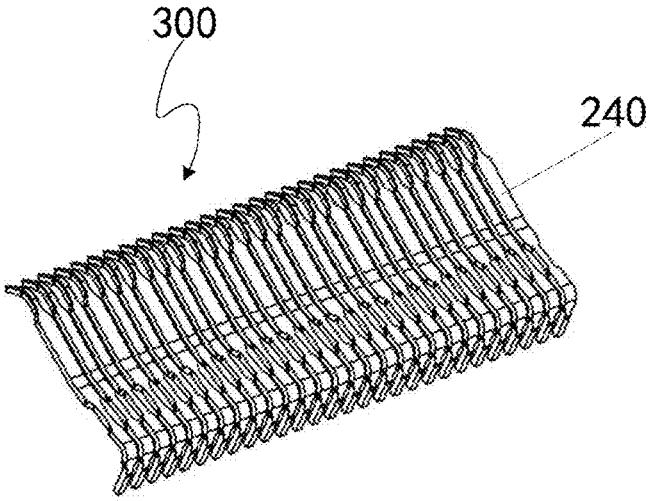
FIG. 8C is a perspective view of the terminal row shown in FIG. 8A.

A plurality of sets of three terminals 200 may be arranged in terminal rows, with the terminals in each terminal row aligned therein. FIG. 8A is a front view of a terminal row 300 formed by nine sets of three terminals and an additional ground terminal 240, according to some embodiments. FIG. 8B is a bottom view of the terminal row 300 shown in FIG. 8A. FIG. 8C is a perspective view of the terminal row 300 shown in FIG. 8A. A set of three terminals 200 is arranged such that the tip portion of each terminal in the terminal row 300 is the same distance from the tip portion of each adjacent terminal. For example, if the pitch of the tip portions of the terminals in a set of three terminals 200 is 0.6 mm, then the pitch between the tip portions of the terminals from an immediately adjacent set of three terminals 200 is also 0.6 mm. It should be appreciated that the plurality of terminals 200 may be in other suitable forms.

Figure 5A:
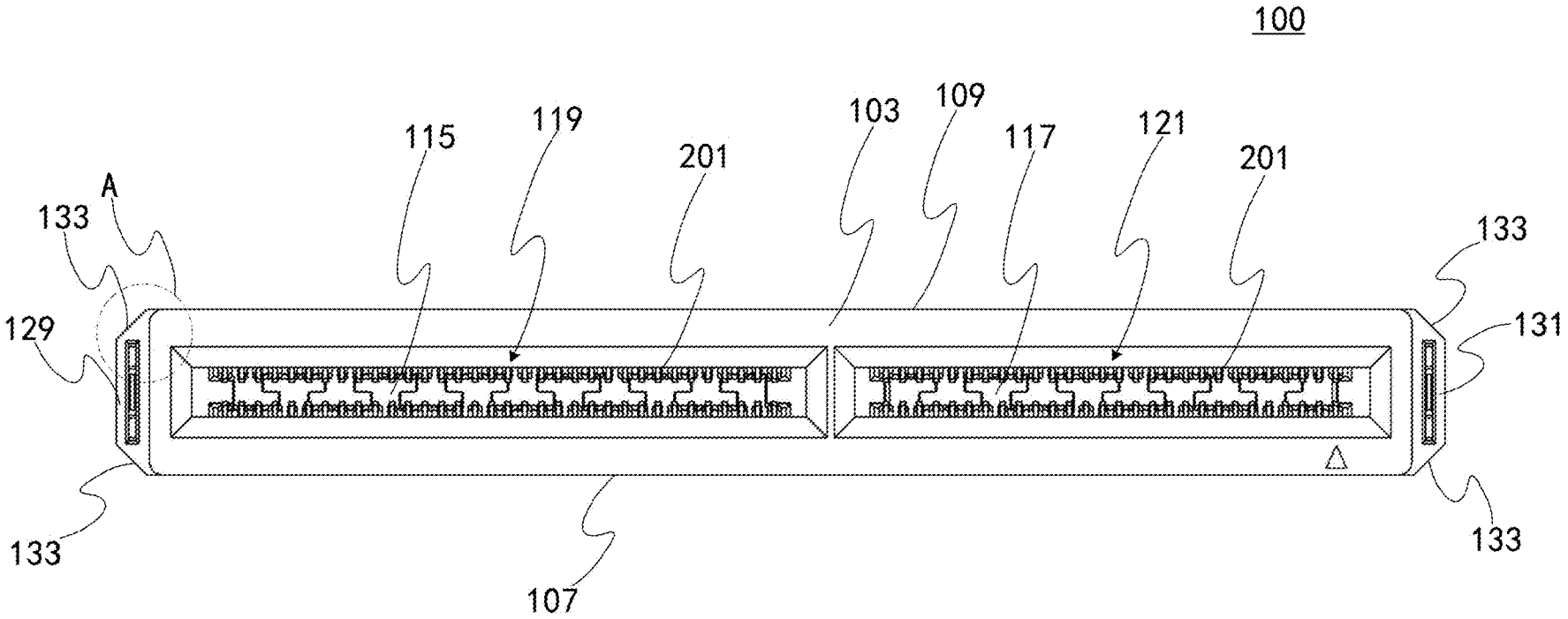
FIG. 5A is a top plan view of the vertical connector shown in FIG. 1.
Figure 6:
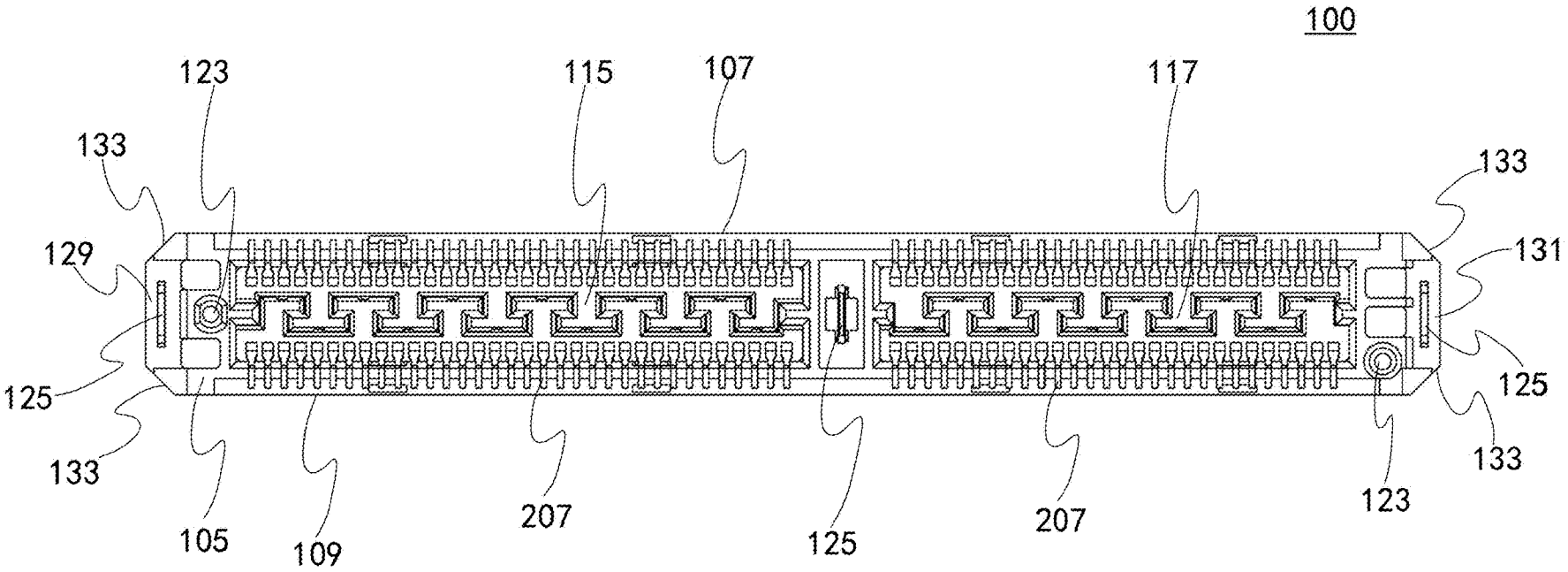
FIG. 6 is a bottom plan view of the vertical connector shown in FIG. 1.

As shown in FIGS. 5A and 6, when the terminals 200 are received in the housing 101, the terminals 200 are arranged in two terminal rows mutually opposed and spaced apart, with the terminals in each terminal row aligned therein. The two terminal rows may be spaced apart in a manner that the terminals 200 are offset from each other or aligned with each other. Conductive portions of the second PCB (e.g., a daughter board) may be inserted between the two terminal rows, such that the conductive portions of the second PCB are disposed in contact with the contact portions 203 of the corresponding terminals 200.

In some embodiments, the vertical connector 100 may include at least one retention mechanism for retaining the plurality of terminals 200 in place relative to each other. The retention mechanism may be partially or entirely formed of an insulative material. Examples of insulative materials that are suitable for forming the retention mechanism include, but are not limited to, plastic, nylon, liquid crystal polymer (LCP), polyphenyline sulfide (PPS), high temperature nylon or polyphenylenoxide (PPO) or polypropylene (PP).

At least one retention mechanism may be overmolded around the plurality of terminals 200. In some examples, the at least one retention mechanism may be formed separately from the housing 101 and then removably mounted into the housing 101. Turning back to FIGS. 2, 3, 5A and 6, two retention mechanisms, i.e., a first retention mechanism 115 and a second retention mechanism 117, are shown in the figures. In some examples, each of the first retention mechanism 115 and the second retention mechanism 117 may be overmolded around a certain number of terminals 200 so as to retain the terminals in two terminal rows mutually opposed and spaced apart.

Then, the first retention mechanism 115 and the second retention mechanism 117 may be fitted into the housing 101, thereby retaining the terminal rows in the housing 101. In some examples, the first retention mechanism 115 and the second retention mechanism 117 may be provided with snap fit mechanisms for cooperating with corresponding mechanisms of the housing 101 so as to secure the retention mechanisms in the housing 101. In some examples, as shown in FIGS. 2, 3, 5A and 6, at least one of the first retention mechanism 115 and the second retention mechanism 117 may be a two-piece retention mechanism, which may include two halves having interlocking mechanisms, with each half retaining a terminal row formed by some of the plurality of terminals 200. Each half retains a terminal row and the two halves are locked in place relative to each other by the interlocking mechanisms. It should be appreciated that the vertical connector 100 may have other numbers and/or other forms of retention mechanisms. It should also be appreciated that the retention mechanism is not mandatory, but just optional. In some embodiments, the housing 101 may be overmolded directly around the terminal 200, without the need for a separate retention mechanism. That is, the housing 101 itself forms a retention mechanism.

As shown in FIGS. 2, 3, 5A and 6, when the terminals 200 are retained in the housing 101, the tail portions 207 of the terminals 200 may be arranged to protrude from the bottom face 105 of the housing 101 for connecting to the corresponding conductive portions of the first PCB (e.g., a motherboard). For example, each of the tail portions 207 may be bent in opposite directions relative to the body portion 205 so as to be connected to the first PCB. The connections may be achieved by soldering or other suitable means.

The top face 103 of the housing 101 of the vertical connector 100 may include at least one socket for allowing the contact portion 203 of each of the plurality of terminals 200 to be accessible therethrough. For example, the second PCB (e.g., a daughter board) may be inserted into the at least one socket, such that conductive portions (e.g., conductive traces) of the second PCB are arranged in contact with the contact portions 203 of the corresponding terminals 200. For example, the conductive portions of the second PCB may be received between two terminal rows mutually opposed and in contact with the contact portions 203 of the corresponding terminals 200. In this way, the conductive portions of the second PCB may be electrically connected to the corresponding conductive portions of the first PCB via the terminals 200, thereby establishing an electrical connection between the second PCB and the first PCB. The first PCB and the second PCB may communicate with each other by transmitting signals via the vertical connector 100 using a standardized protocol, such as a PCI protocol. Two sockets, i.e., a first socket 119 and a second socket 121, are shown in FIGS. 1 and 5A. The second socket 121 may receive a different portion of the same PCB being received by the first socket 119, or a different PCB. In some examples, the first socket 119 and the second socket 121 may be designed to provide access to a different number of terminals. For example, the first socket 119 may provide access to 68 (sixty eight) terminals and the second socket 121 may provide access to 56 (fifty six) terminals. In an aspect, this may allow the vertical connector to receive PCBs of different sizes. In another aspect, this may provide a dummy-proof design to prevent intentional or unintentional combinational or operational errors. It should be appreciated that the top face 103 of the housing 101 may have other numbers of sockets, such as one socket or more than two sockets. It should also be appreciated that the number of sockets may be the same as or different from that of retention mechanisms. For example, when the top face 103 of the housing 101 includes two sockets, the vertical connector 100 may include two retention mechanisms to allow the contact portions 203 of the plurality of terminals 200 to be accessible through the two sockets.

The vertical connector 100 may further include a positioning mechanism provided on the housing 101 for ensuring a proper positioning of the vertical connector 100 on the first PCB when the vertical connector 100 is mounted to the first PCB. For example, the positioning mechanism may be in the form of a positioning protrusion, with two positioning protrusions 123 shown in FIGS. 2 to 4 and 6. The two positioning protrusions 123 are provided on the bottom face 105 of the housing 101, near opposite ends of the vertical connector 100, respectively. However, it should be appreciated that the positioning protrusions 123 may be provided at other suitable locations on the bottom face 105. The positioning protrusions 123 may also be designed to provide a dummy-proof design to prevent the vertical connector 100 from being intentionally or unintentionally mounted to the first PCB in a wrong orientation. For example, when the vertical connector 100 is mounted to the first PCB, the positioning protrusions 123 may cooperate with corresponding positioning mechanisms (e.g., recesses or openings) in the first PCB to ensure a proper positioning of the vertical connector 100 on the first PCB. It should be appreciated that the vertical connector 100 may have other numbers and/or other forms of positioning mechanism.

The vertical connector 100 may further include a fixing mechanism for fixing the vertical connector 100 to the first PCB. For example, the fixing mechanism may be in the form of a fixing tab, with three fixing tabs 125 shown in FIGS. 2 to 4 and FIG. 6. The fixing tabs 125 may be formed of a metallic or non-metallic material. Receiving slots 127 may be formed in end portions of the housing 101 of the vertical connector 100 for receiving the fixing tabs 125. Each of the fixing tabs 125 may be received in the corresponding receiving slot 127 and protrude from the bottom face 105 of the connector 100, with the protruded portion of the fixing tab 125 received by a mating portion of the first PCB, whereby the vertical connector 100 may be securely fixed to the first PCB. In some examples, a portion of the fixing tab 125 protruding from the bottom face 105 of the connector 100 may be provided with a mounting hole. In some examples, each of the fixing tab may be T-shaped. It should be appreciated that the vertical connector 100 may have other numbers and/or other forms of fixing mechanisms.

In order to minimize a space occupied by the vertical connector 100 on the first PCB, a corner portion between at least two adjacent side faces of the side faces of the housing 101 may be formed as a chamfered surface 133 so as to reduce the space occupied by the housing 101 on the first PCB. In some examples, the corner portion between at least two adjacent side faces of the front side face 107, the rear side face 109, the left side face 111 and the right side face 113 of the housing 101 is formed as a chamfered surface 133. In some examples, all of the corner portions between adjacent side faces of the housing 101 are formed as chamfered surfaces 133. In some examples, the corner portions between adjacent side faces of the housing 101 proximate to an edge of the first PCB are each formed as a chamfered surface 133.

In conventional vertical connectors, the corner portions between adjacent side faces are typically formed as rounded or beveled portions. As compared with conventional vertical connectors, the corner portions between adjacent side faces of the vertical connector 100 being formed as chamfered surfaces may reduce a dimension of the vertical connector 100 and thus reduce the space occupied by the housing 101 on the first PCB. As such, the vertical connector 100 may be disposed closer to other components on the first PCB, thereby allowing for a more compact arrangement of components on the PCB. In addition, the vertical connector 100 may also be disposed closer to an edge of the first PCB, such that the space utilization on the first PCB may be optimized. These allow for reducing the dimension of the PCB, such that the entire assembly, including the vertical connector and PCB, may be manufactured at a lower cost, and may be more miniaturized and more lightweight.

Figure 5B:
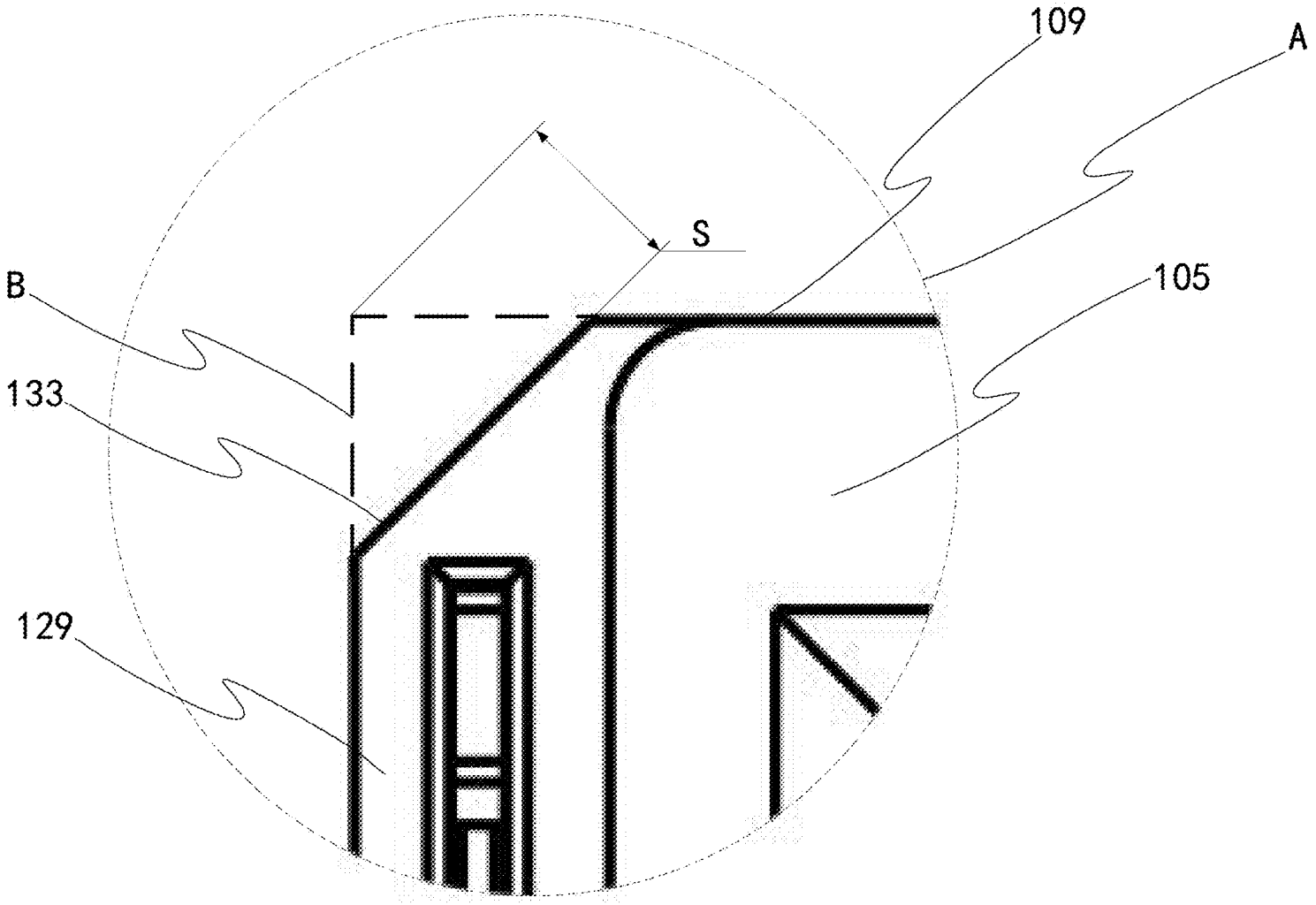
FIG. 5B is an enlarged view of the area A circled by the dashed line in FIG. 5A.

FIG. 5B illustrate a comparison of the case where the corner portions between adjacent side faces of the vertical connector 100 are not formed as the chamfered surfaces 133 and the case where the corner portions are formed as the chamfered surfaces 133, wherein the dashed line B represents a general profile of the corner portions between adjacent side faces of the vertical connector 100 in the case where the corner portions are not formed as the chamfered surfaces 133. As compared to the case where the corner portions between adjacent side faces of the vertical connector 100 are not formed as the chamfered faces 133, the corner portions between adjacent side faces of the vertical connector 100 being formed as chamfered face 133 allows the corner portions to be indented inward by a distance S, wherein the distance S is a vertical distance from an intersection line of planes in which the adjacent side faces of the vertical connector 100 are located to the corresponding chamfered face 133. For some small size vertical connectors 100 (e.g., the 0.6 mm card edge connector as described above), the corner portions between adjacent side faces being formed as chamfered surfaces 133 allows the corner portions to be indented inward by at least 0.36 mm, as compared to the case where the corner portions are not formed as the chamfered surfaces 133.

Figure 5C:
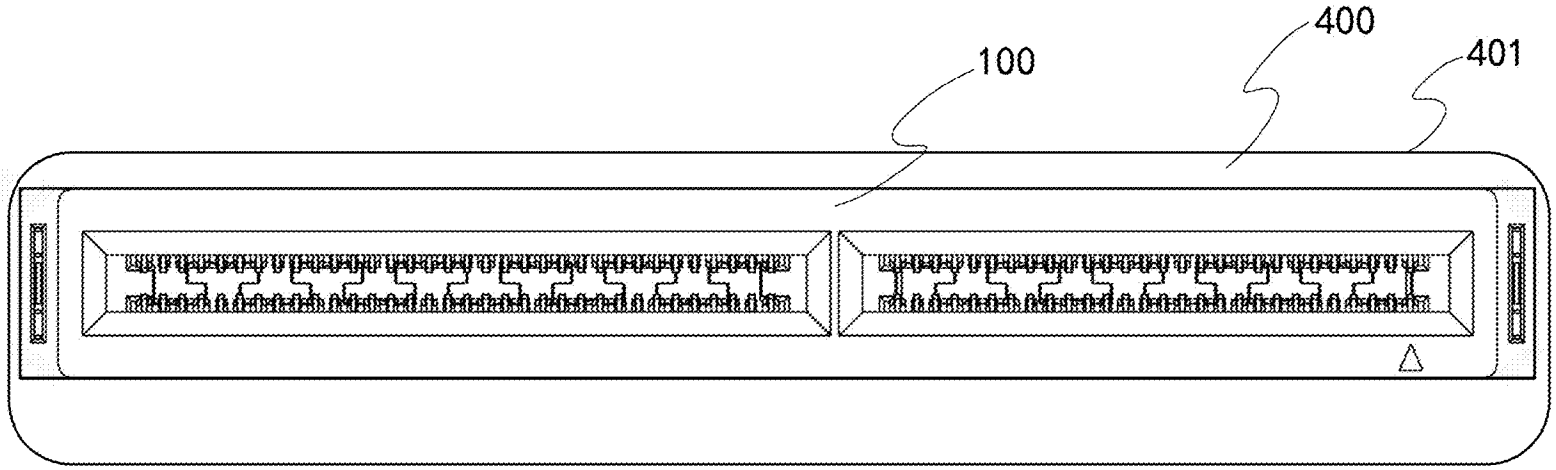
FIG. 5C is a top plan view of a printed circuit board mounted with a vertical connector that have conventional corner portions.
Figure 5D:
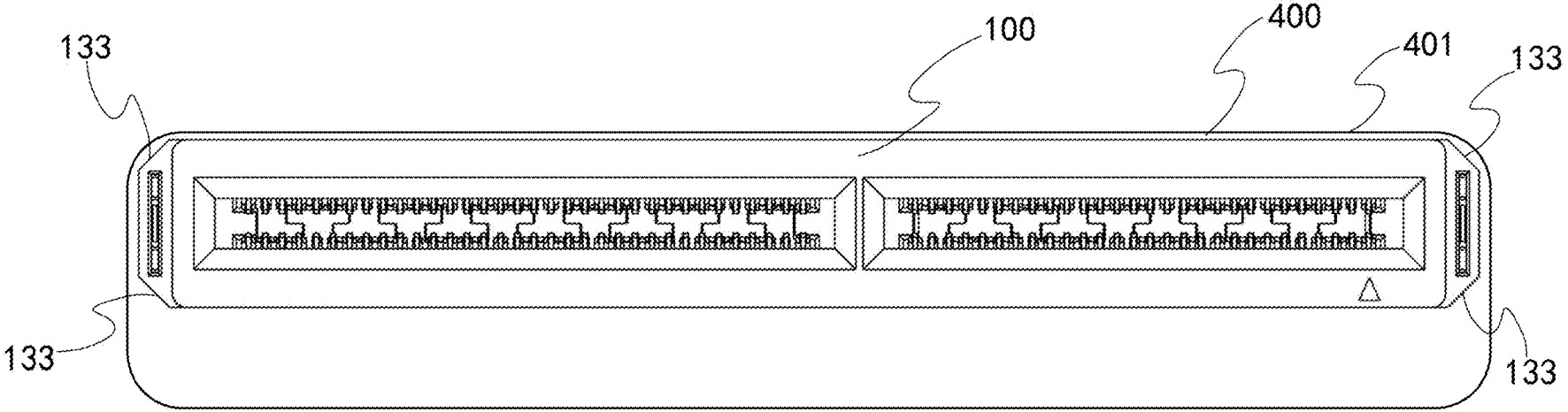
FIG. 5D is a top plan view of a printed circuit board mounted with the vertical connector of FIG. 1, which has chamfered corner portions.

FIGS. 5C and 5D schematically illustrate the arrangements of the vertical connector 100 relative to an edge 401 of the printed circuit board 400 in the cases where the corner portions of the vertical connector 100 are not formed as the chamfered surfaces 133 and are formed as the chamfered surfaces 133, respectively, wherein FIG. 5C schematically illustrates a general profile of the corner portions between adjacent side faces of the vertical connector 100 in the case where the corner portions of the vertical connector 100 are not formed as the chamfered surfaces 133. In some examples, the printed circuit board 400 may have curved edges. As can be seen from FIGS. 5C and 5D, the corner portions between adjacent side faces of the vertical connector 100 being formed as the chamfered surfaces 133 allows the corner portions to be indented inwardly such that the vertical connector 100 can be disposed closer to an edge 401 of the printed circuit board 400 when mounted on the printed circuit board 400, as compared to the case where the corner portions are not formed as the chamfered surfaces 133. This allows the space utilization on the printed circuit board 400 to be optimized, thereby allowing for reducing a dimension of the printed circuit board 400, which in turn allows the entire assembly, including the vertical connector 100 and the printed circuit board 400, to be manufactured at a lower cost, and to be more miniaturized and more lightweight.

In some embodiments, portions of opposite ends of the housing 101 that are proximate to the bottom face 105 may protrude outward to form a platform. As shown in FIGS. 1 to 6, portions of the left and right ends of the housing 101 that are proximate to the bottom face 105 protrude outwardly to form a first platform 129 and a second platform 131, respectively. The first platform 129 and the second platform 131 may be configured to provide additional mechanical support to the vertical connector 100 when the vertical connector 100 is mounted to the first PCB. In some examples, the receiving slots 127 for receiving the fixing tabs 125 may be formed in the first platform 129 and the second platform 131. In some examples, the receiving slots 127 for receiving the fixing tabs 125 may be formed through the first platform 129 and the second platform 131. In this case, the fixing tabs 125 may be fitted into the receiving slot 127 from a side of the first platform 129 and the second platform 131 opposite to the bottom face 105 and then protrude partially from the bottom face 105. It should be appreciated that the housing 101 may have only one platform.

Figure 4:
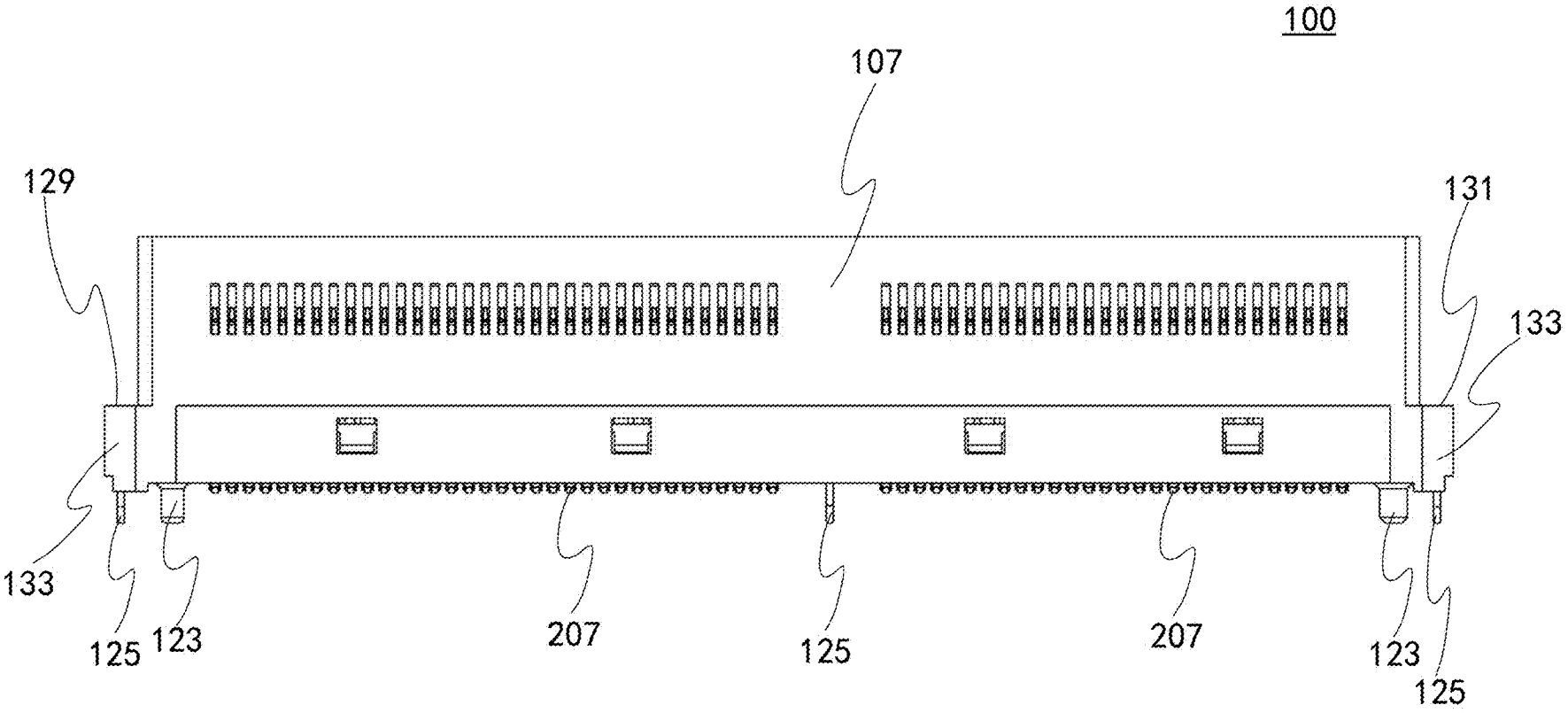
FIG. 4 is a front plan view of the vertical connector shown in FIG. 1.

As shown in FIGS. 1 to 6, the chamfered surfaces 133 may be formed in corner portions of the first platform 129 and the second platform 131, respectively, to reduce the space occupied by the platform on the first PCB, thereby reducing the space occupied by the housing 101 on the first PCB. In some examples, as shown in FIGS. 4 to 6, the chamfered surfaces 133 may be formed in the two corner portions of each of the first platform 129 and the second platform 131, such that the first platform 129 and the second platform 131 each tapers outwardly, resulting in that each of the first platform 129 and the second platform 131 has a substantially trapezoidal shape. In this way, it is possible to allow the vertical connector 100 to occupy less space and to be disposed closer to other components on the first PCB, thereby allowing for a more compact arrangement for the components on the PCB. In addition, the vertical connector 100 may also be disposed closer to an edge of the first PCB such that the space utilization on the first PCB may be optimized. These allow for reducing a dimension of the PCB, such that the entire assembly, including the vertical connector and PCB, may be manufactured at a lower cost, and may be more miniaturized and more lightweight. It should be appreciated that the housing 101 of the vertical connector 100 may have one platform or more than two platforms.

Although the present disclosure is described in detail above in connection with a vertical connector, it should be appreciated that the present disclosure is also applicable to right angle connectors. Unlike the vertical connector 100, in a right angle connector, a socket is formed in a side face of the insulative housing, rather than a top face thereof, and terminals of the right angle connector are configured such that contact portions of the terminals are accessible via the socket. For example, the right angle connector may be used to connect a mezzanine card to a mother board. In some examples, the right angle connector may be configured to be mounted to a first PCB (such as a motherboard), such that the tail portions of the terminals of the right angle connector are electrically connected to the conductive portions (for example, conductive traces) of the first PCB. A second PCB (such as a mezzanine card) may be inserted into the socket such that the conductive portions of the second PCB are disposed in contact with the contact portions of the corresponding terminals. In this way, the conductive portions of the second PCB may be electrically connected to the corresponding conductive portions of the first PCB via the terminals of the right angle connector, thereby establishing an electrical connection between the second PCB and the first PCB. The first PCB and the second PCB may communicate with each other by transmitting signals using the right angle connector using a standardized protocol, such as a PCI protocol.

It should also be appreciated that the terms "first" and "second" are only used to distinguish an element or component from another element or component, and that these elements and/or components should not be limited by the terms.

The present disclosure has been described in detail in conjunction with specific embodiments. Obviously, the above description and the embodiments shown in the appended drawings should be understood to be exemplary and do not constitute a limitation on the present disclosure. For the person skilled in the art, various variations or modifications falling within the scope of the present disclosure can be made without departing from the spirit of the present disclosure.

What is claimed is:

1. An electrical connector, comprising:

an insulative housing comprising a top face comprising a socket, a bottom face opposite to the top face, and a plurality of side faces extending between the top face and the bottom face, the plurality of side faces comprising a first side face, a second side face extending perpendicularly to the first side face, a third side face extending perpendicular to the first side face, and a fourth side face extending perpendicular to the second side face; and a plurality of terminals disposed in the insulative housing, each of the plurality of terminals comprising a contact portion and a tail portion, the contact portion being accessible through the socket of the insulative housing, and the tail portion protruding from the bottom face of the insulative housing;

wherein the insulative housing comprises a first chamfered surface connecting the first side face and the second side face, a second chamfered surface connecting the second side face and the fourth side face, and a third chamfered surface connecting the third side face and the fourth side face.

2. An electrical connector, comprising:

an insulative housing comprising a top face comprising a socket, a bottom face opposite to the top face, and a plurality of side faces extending between the top face and the bottom face, the plurality of side faces comprising a first side face, a second side face extending perpendicularly to the first side face, and a third side face extending perpendicular to the first side face; and a plurality of terminals disposed in the insulative housing, each of the plurality of terminals comprising a contact portion and a tail portion, the contact portion being accessible through the socket of the insulative housing, and the tail portion protruding from the bottom face of the insulative housing, wherein:

the insulative housing comprises a platform projecting outwardly at one end of the insulative housing that is proximate to the bottom face and comprising the second side face; and the insulative housing comprises a first chamfered surface connecting the first side face and the first side face, and a second chamfered surface connecting the second side face and the fourth side face.

3. The electrical connector of claim 1, wherein:

the insulative housing comprises first and second platforms projecting outwardly at opposite ends of the insulative housing, respectively;

the first platform comprises the second side face; and the second platform comprises the third side face.

4. The electrical connector of claim 3, wherein:

the first platform comprises the first chamfered surface and the second chamfered surface such that the first platform has a trapezoidal shape; and the second platform comprises the third chamfered surface and the fourth chamfered surface such that the second platform has a trapezoidal shape.

5. The electrical connector of claim 1, wherein the plurality of terminals are arranged in two terminal rows mutually opposed and spaced apart in the insulative housing, with the terminals in each terminal row aligned therein.

6. The electrical connector of claim 1, further comprising:

at least one retention mechanism for retaining the plurality of terminals in place relative to each other.

7. The electrical connector of claim 6, wherein the at least one retention mechanism is overmolded around the plurality of terminals.

8. The electrical connector of claim 6, wherein the insulative housing comprises the at least one retention mechanism.

9. The electrical connector of claim 6, wherein the at least one retention mechanism is formed separately from the insulative housing and removably mounted into the insulative housing.

10. The electrical connector of claim 9, wherein the retention mechanism comprises two halves having interlocking mechanisms, each half retaining a terminal row formed by some of the plurality of terminals.

11. The electrical connector of claim 1, further comprising:

a positioning mechanism for ensuring a proper positioning of the electrical connector on an electronic system when the electrical connector is mounted to the electronic system.

12. The electrical connector of claim 1, further comprising:

a fixing mechanism for fixing the electrical connector to an electronic system.

13. The electrical connector of claim 1, wherein the electrical connector is a vertical connector or a right angle connector.

14. The electrical connector of claim 12, wherein the electronic system is a printed circuit board.

15. The electrical connector of claim 1, wherein:

the first side face extends in a first plane, the second side face extends in a second plane, the first plane and the second plane cross each other along a line, and the first chamfered surface is spaced from the line by a distance no less than 0.36 mm.

16. The electrical connector of claim 2, wherein:

the platform comprises slots for receiving tabs.

17. An electronic system, comprising:

a printed circuit board; and an electrical connector comprising:

an insulative housing comprising a socket, a bottom face mounted against the printed circuit board, and a plurality of side faces extending perpendicular to the bottom face, the plurality of side faces comprising first and second side faces extending perpendicularly to each other; and a plurality of terminals disposed in the insulative housing, each of the plurality of terminals comprising a contact portion and a tail portion, the contact portion being accessible through the socket of the insulative housing, and the tail portion protruding from the bottom face of the insulative housing;

wherein:

the printed circuit board comprises a first edge and a second edge and curved corner joining the first edge and the second edge;

the electrical connector is mounted to the printed circuit board with the first side face adjacent and parallel to the first edge and the second side face adjacent and parallel to the second edge; and the insulative housing comprises an angled surface connecting the first side face and the second side face, the angled surface being mounted adjacent to the curved corner.

18. The electronic system of claim 17, wherein:

the insulative housing comprises a socket portion including the socket and at least one platform extending from the socket portion in a direction parallel to the bottom face; and the angled surface comprises a surface of a platform of the at least one platform.

19. The electronic system of claim 18, wherein:

the platform is a first platform;

the at least one platform comprises a second platform, extending from the socket portion in a direction opposite the first platform;

the angled surface is a first angled surface; and the second platform comprises a second angled surface.

20. The electronic system of claim 19, further comprising:

a plurality of fixing tabs extending through the first platform and the second platform and engaging the electrical connector to the printed circuit board.

* * * * *